US007677953B2

(12) United States Patent
Oyama et al.

(10) Patent No.: US 7,677,953 B2
(45) Date of Patent: Mar. 16, 2010

(54) CROTCH-POSESSING CORRECTIVE GARMENT

(75) Inventors: Makoto Oyama, Kyoto (JP); Atsuko Misaki, Kyoto (JP)

(73) Assignee: Wacoal Corp., Kyoto (JP)

( * ) Notice: Subject to any disclaimer, the term of this patent is extended or adjusted under 35 U.S.C. 154(b) by 525 days.

(21) Appl. No.: 10/517,282

(22) PCT Filed: Jun. 5, 2003

(86) PCT No.: PCT/JP03/07142

§ 371 (c)(1),
(2), (4) Date: Jan. 4, 2005

(87) PCT Pub. No.: WO03/103422

PCT Pub. Date: Dec. 18, 2003

(65) Prior Publication Data

US 2005/0239370 A1 Oct. 27, 2005

(30) Foreign Application Priority Data

Jun. 6, 2002 (JP) ..... 2002-166166

(51) Int. Cl.
*A41C 9/00* (2006.01)
*A41B 1/00* (2006.01)

(52) U.S. Cl. ..... 450/94; 450/106; 450/112; 2/228

(58) Field of Classification Search ..... 450/94–101, 450/106, 112, 114, 115, 151; 2/228, 236
See application file for complete search history.

(56) References Cited

U.S. PATENT DOCUMENTS

| | | | | |
|---|---|---|---|---|
| 2,949,917 | A * | 8/1960 | Arcuri | 450/117 |
| 3,395,712 | A * | 8/1968 | Laguzzi | 450/115 |
| 3,894,542 | A * | 7/1975 | Sacristan | 450/123 |
| 5,109,546 | A * | 5/1992 | Dicker | 2/70 |
| 6,728,973 | B1 * | 5/2004 | Webley et al. | 2/400 |

FOREIGN PATENT DOCUMENTS

| | | |
|---|---|---|
| CN | 1298282 A | 6/2001 |
| CN | 1300193 A | 6/2001 |

(Continued)

OTHER PUBLICATIONS

International Search Report for PCT/JP03/07142 mailed on Jul. 22, 2003.

(Continued)

*Primary Examiner*—Gloria Hale
(74) *Attorney, Agent, or Firm*—Darby & Darby P.C.

(57) ABSTRACT

A (short or long) girdle constituted including, in an area fitting over a wearer's body, tightening portions for which the magnitude of the tightening force varies with direction. The tightening fabric portions 21 each run from above the anal cleft, passing above the left or right buttock to the vicinity of the left or right greater trochanter when the girdle is being worn, and the tightening force in the direction in which each tightening fabric portion 21 runs is made to be low. Moreover, supplementary tightening fabric portions 22 are provided running along the tightening fabric portions 21 in front of the tightening fabric portions 21, and the tightening force in the direction in which each supplementary tightening fabric portion runs is made to be low.

21 Claims, 25 Drawing Sheets

FOREIGN PATENT DOCUMENTS

| | | | |
|---|---|---|---|
| JP | 06-173101 | | 6/1994 |
| JP | 08-311704 | | 11/1996 |
| JP | 10-008303 | | 1/1998 |
| JP | 10-110306 | A | 4/1998 |
| JP | 10-292209 | | 11/1998 |
| JP | 11-061516 | A | 3/1999 |
| JP | 2000-008203 | | 1/2000 |
| JP | 2001-104369 | | 4/2001 |
| JP | 2001-192903 | | 7/2001 |
| JP | 2002-235207 | | 8/2002 |
| WO | WO-99/58007 | | 11/1999 |

OTHER PUBLICATIONS

Patent Abstracts of Japan for JP 2002-235207 published on Aug. 23, 2002.

Patent Abstracts of Japan for JP 10-292209 published on Nov. 4, 1998.

Patent Abstracts of Japan for JP 2000-008203 published on Jan. 11, 2000.

Patent Abstracts of Japan for JP 08-311704 published on Nov. 26, 1996.

Patent Abstracts of Japan for JP 2001-192903 published on Jul. 17, 2001.

Patent Abstracts of Japan for JP 06-173101 published on Jun. 21, 1994.

Patent Abstracts of Japan for JP 10-008303 published on Jan. 13, 1998.

Patent Abstracts of Japan for JP 2001-104369 published on Apr. 17, 2001.

* cited by examiner

CROTCH-POSESSING CORRECTIVE GARMENT

CROSS-REFERENCE TO PRIOR APPLICATION

This is a U.S. national phase application under 35 U.S.C. §371 of International Patent Application No. PCT/JP03/07142 filed Jun. 5, 2003, and claims the benefit of Japanese Patent Application No. 2002-166166 filed Jun. 6, 2002 both of which are incorporated by reference herein. The International Application was published in Japanese on Dec. 18, 2003 as WO 03/103422 A1 under PCI Article 21(2).

TECHNICAL FIELD

The present invention relates to a crotch-possessing corrective garment such as a girdle for posture correction.

BACKGROUND ART

As such a crotch-possessing corrective garment, for example the girdle of Japanese Patent Application Laid-open No. 2001-192903 is known. Here, a belt-shaped strongly tightening portion that produces a strong tightening force is provided from the sacrum along the direction of muscular fibers of the gluteus maximus muscle, and with a principle objective of stabilizing the hip joint, a function of weakening forward curvature of the lumbar vertebra is realized. Moreover, as girdles used with an objective of treating lumbago, straightening the spine and so on, girdles disclosed in, for example, Japanese Patent Application Laid-open No. 6-173101, Japanese Patent Application Laid-open No. 10-8303, Japanese Patent Application Laid-open No. 2001-104369 and Japanese Patent Application Laid-open No. 2001-192903 are known.

With the girdle of Japanese Patent Application Laid-open No. 6-173101, belt-shaped pelvis-correcting pieces that tighten the lumbar region in a horizontal direction are attached, and in Japanese Patent Application Laid-open No. 10-8303, a girdle having belt-shaped fixings attached thereto is disclosed. Moreover, in Japanese Patent Application Laid-open No. 2001-104369, a girdle in which bands made of a stretchable material are wound around the lumbar region is disclosed.

However, with such conventional girdles, there is little posture correction effect, and handling has also been difficult. For example, with the girdles disclosed in Japanese Patent Application Laid-open No. 6-173101 and Japanese Patent Application Laid-open No. 10-8303, belt-shaped correcting pieces or fixings that are separate to the main body of the garment (or have one end thereof sewn onto the main body) are used, and hence handling is difficult. Regarding the girdle of Japanese Patent Application Laid-open No. 2001-104369, again stretchable bands that are separate to the main body of the garment are used, and hence there is a feeling of awkwardness when wearing the garment and thus handling is not easy. Moreover, these girdles have as their principle objective treating lumbago, and there is little effect of improving postural balance.

In this way, as conventional posture correction type garments, there have mainly been stoop-correcting garments for the upper half of the body and lumbago-preventing garments for the lower half of the body, but there have been no attempts to improve the posture of the whole body by acting around the pelvis.

DISCLOSURE OF THE INVENTION

It is an object of the present invention to provide a crotch-possessing corrective garment that can act on muscles around the pelvis to improve posture, and moreover is easy to handle and can be worn with no feeling of awkwardness.

According to the research of the present inventors, there are many people whose postural balance becomes poor due to the pelvis being tilted backward or being upright, and who thus stoop. Taking people having various problems with their postural balance as monitors, taping was thus carried out along the muscles around the pelvis (the piriform muscles, the iliopsoas muscles, the sacrospinalis muscles, the external oblique muscles etc.), and posture changes and the subjective feeling (feeling when worn) were studied.

As a result, it was ascertained that for people whose pelvis tends to be upright or be tilted backward in particular, providing piriform muscle support has a large posture correction effect, and upon using in combination with iliopsoas muscle and external oblique muscle support, yet better effects can be expected. On the other hand, a significant posture correction effect was not observed for the sacrospinalis muscles.

Out of the muscles around the pelvis, the positions of the piriform muscles, the iliopsoas muscles and the external oblique muscles are as shown by the hatching in FIGS. 1A to 1C. As shown in FIG. 1A in which the pelvis is viewed from the rear, each piriform muscle is a muscle that is positioned on a hip joint and is for outwardly rotating the hip joint. As shown in FIG. 1B in which the body is viewed from the front, each iliopsoas muscle is positioned in the lumbar region. In general, the greater psoas muscle and the iliac muscle are referred to together as the iliopsoas muscle; these muscles are also referred to collectively as the deep abdominal muscle group due to being positioned between the internal organs and the spine, and together with the straight muscle of the thigh constitute the hip joint flexor muscles. As shown in FIG. 1C in which the body is viewed from the front, each external oblique muscle is positioned over a broad area from the lumbar region over the abdomen and up to the chest.

Moreover, the positions of the greater trochanters, the ilia, the sacrum and the fifth lumbar vertebra are as shown in FIGS. 2A to 2D. FIG. 2A shows the skeleton for the case of viewing the body from the front, FIG. 2B shows the external form of the body in this case, FIG. 2C shows the skeleton for the case of viewing the body from the rear, and FIG. 2D shows the external form of the body in this case. As shown in FIGS. 2A and 2B, each ilium is positioned on the outside at the top of the pelvis, and as shown in FIGS. 2C and 2D, each greater trochanter is positioned at the top of a femur. Moreover, as shown by the hatching in FIGS. 2C and 2D, the sacrum is positioned at the bottom of the lumbar vertebra in the center of the pelvis, and as shown in FIGS. 2C and 2D, the fifth lumbar vertebra is positioned above the sacrum.

To attain the above object, a crotch-possessing corrective garment according to the present invention is constituted including, in an area fitting over a wearer's body, a tightening portion for which the magnitude of a tightening force varies with direction, and is characterized in that when the garment is being worn, the tightening portion runs from above the anal cleft, passing above the left and right buttocks, to the vicinities of the left and right greater trochanters, and the tightening force in the direction in which the tightening portion runs is made to be lower than the tightening force in the direction orthogonal thereto.

According to the present invention, the tightening portion that applies a tightening force to the wearer's body is provided in an area fitting over the wearer's body so as to form a constituent element of the garment itself, and hence handling is easy, and there is no detriment to the feeling when worn. Moreover, when the garment is being worn, the tightening portion, which runs from above the anal cleft, passing above the left and right buttocks, to the vicinities of the left and right greater trochanters is constituted such that the tightening force in the direction in which the tightening portion runs is low (i.e. is high in the direction orthogonal thereto), and hence the tightening portion has an action of supporting the piriform muscles and pushing a somewhat upper part of the sacrum from the rear. That is, in a belt-shaped area running from above the anal cleft, passing above the left and right buttocks, to the vicinities of the left and right greater trochanters, a strong tightening force acts in the direction orthogonal to the direction in which the tightening portion runs, and hence the buttocks are somewhat extended and the tension in the flanks is increased, and thus there is an action of turning in the flanks and pushing out the backside.

A crotch-possessing corrective garment according to the present invention is constituted including, in an area fitting over a wearer's body, a left/right pair of tightening portions for which the magnitude of a tightening force varies with direction, and is characterized in that when the garment is being worn, each of the left/right pair of tightening portions runs from the vicinity of the left or right greater trochanter to above the left or right buttock such as to point to above the anal cleft, and the tightening force in the direction in which each of the left/right pair of tightening portions runs is made to be lower than the tightening force in the direction orthogonal thereto.

According to the present invention, the left/right pair of tightening portions that apply a tightening force to the wearer's body are provided in left and right areas fitting over the wearer's body so as to form constituent elements of the garment itself, and hence handling is easy, and there is no detriment to the feeling when worn. Moreover, when the garment is being worn, the left/right pair of tightening portions, which each runs from above the anal cleft, passing above the left or right buttock, to the vicinity of the left or right greater trochanter are made to be such that the tightening force in the direction in which the tightening portion runs is low (i.e. is high in the direction orthogonal thereto), and hence the tightening portions have an action of supporting the piriform muscles and pushing a somewhat upper part of the sacrum from the rear. That is, in a belt-shaped area running from above the anal cleft, passing above the left and right buttocks, to the vicinities of the left and right greater trochanters, a strong tightening force acts in the direction orthogonal to the direction in which the tightening portions run, and hence the buttocks are somewhat extended and the tension in the flanks is increased, and thus there is an action of turning in the flanks and pushing out the backside.

It is preferable for the crotch-possessing corrective garment according to the present invention to further have thigh portions that fit over the wearer's thighs, and for the tightening portions to further run from the vicinities of the greater trochanters along the outsides of the thigh portions; as a result, the function of acting on the muscles around the pelvis and improving the posture of the whole body is increased.

With the crotch-possessing corrective garment according to the present invention, it is preferable for the tightening portions have a shape that is curved above the buttocks when the garment is being worn; as a result, the feeling when worn can be improved.

With the crotch-possessing corrective garment according to the present invention, preferably, when the garment is being worn, in the lumbar region on the left and the right, the tightening portions are forked downward to the front and the rear, and the rear forks pass above the left and right buttocks and run to above the anal cleft, and the front forks run from the greater trochanters upward; as a result, the rear forks act suitably on the piriform muscles, and the front forks act suitably on the iliopsoas muscles, and hence the function of improving the posture can be increased.

With the crotch-possessing corrective garment according to the present invention, preferably, a left/right pair of supplementary tightening portions are provided so as to run along the tightening portions in front of the tightening portions in the lumbar region on the left and the right, and the tightening force in the direction in which each of the left/right pair of supplementary tightening portions runs is made to be lower than the tightening force in the direction orthogonal thereto; as a result, the supplementary tightening portions act suitably on the iliopsoas muscles, and moreover the tightening portions at the rear and the supplementary tightening portions at the front can be constituted from separate materials, and hence the tightening forces acting on the piriform muscles and the iliopsoas muscles can be set suitably.

A crotch-possessing corrective garment according to the present invention is constituted including, in an area fitting over a wearer's body, tightening portions and supplementary tightening portions for which the magnitude of a tightening force varies with direction, and is characterized in that the tightening portions run from the vicinities of the left and right greater trochanters to above the left and right buttocks such as to point to above the anal cleft when the garment is being worn, and the supplementary tightening portions are provided along the tightening portions in front of the tightening portions, and the tightening force in the direction in which each of the tightening portions and the supplementary tightening portions runs is made to be lower than the tightening force in the direction orthogonal thereto.

According to the crotch-possessing corrective garment of the present invention, the left/right pair of tightening portions that apply a tightening force to the wearer's body are provided in left and right areas fitting over the wearer's body so as to form constituent elements of the garment itself, and hence handling is easy, and there is no detriment to the feeling when worn. Moreover, the left/right pair of tightening portions are made to be such that the tightening force in the direction in which the tightening portion runs is low (i.e. is high in the direction orthogonal thereto), and hence the tightening portions have an action of supporting the piriform muscles and pushing a somewhat upper part of the sacrum from the rear. Moreover, the supplementary tightening portions act suitably on the iliopsoas muscles, and as a result there are actions on both the piriform muscles and the iliopsoas muscles, and thus a force that pushes the backside out and a force that makes the wearer's legs turn inward are generated. Furthermore, if a power difference is produced in only a curved line shape, a straight line shape or a specific area by constituting the tightening portions at the rear and the supplementary tightening portions at the front from separate materials, or even if separate materials are not used, by using warp knitting techniques, then the tightening forces acting on the piriform muscles and the iliopsoas muscles can be set suitably.

With the crotch-possessing corrective garment according to the present invention, preferably, the supplementary tightening portions are made so as to broaden in a downward direction when the garment is being worn; as a result, the tightening forces acting on the body near to the greater trochanters can be increased, and hence the effect of improving the posture can be increased.

The crotch-possessing corrective garment according to the present invention preferably further has a body front tightening portion that is constituted from a material having a tightening force, and runs upward to the left and right from above the crotch in the front center when the garment is being worn; as a result, the external oblique muscles can also be acted upon, and hence the posture can be further improved.

With the crotch-possessing corrective garment according to the present invention, the tightening portions may be belt-shaped, and may be formed through power change in a single piece of warp-knitted fabric. Moreover, the crotch-possessing corrective garment may be any of a girdle, spats, sports tights, a leotard, a body suit, or men's pants, tights or spats.

BEST MODE FOR CARRYING OUT THE INVENTION

Figure 1A:
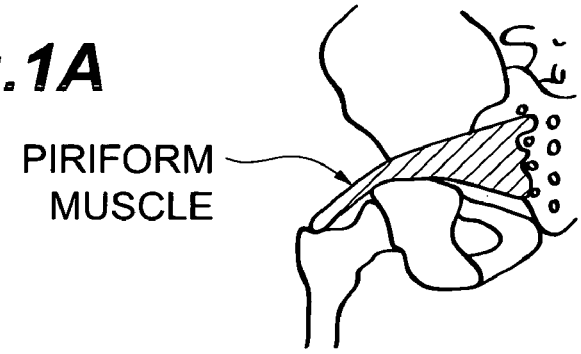
FIG. 1A is a view of a pelvis from the rear.
Figure 1B:
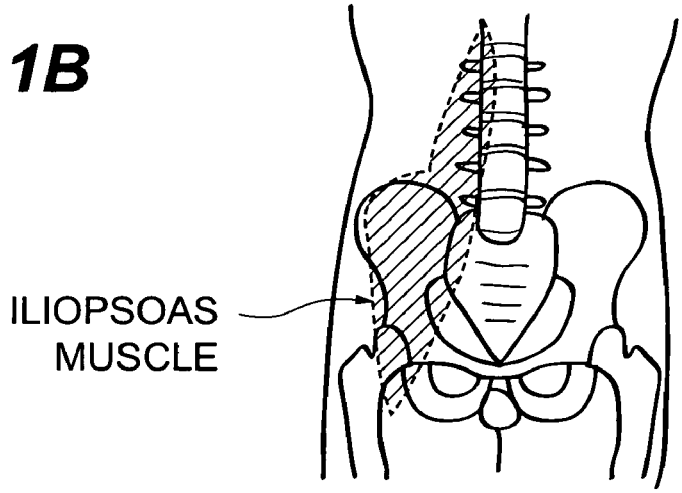
FIG. 1B is a view of a body from the front.
Figure 1C:
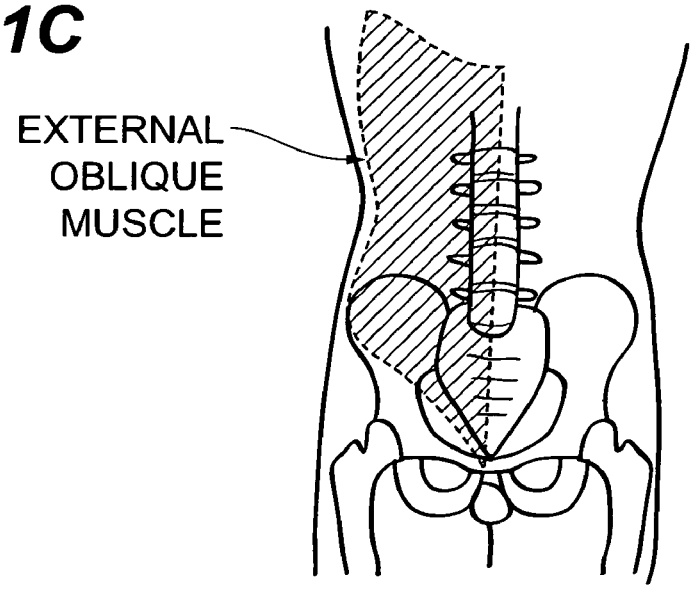
FIG. 1C is a view of a body from the front.
Figure 2A:
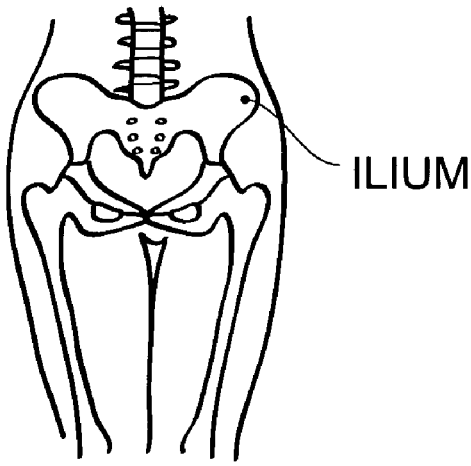
FIG. 2A is a view showing a skeleton for the case of viewing a body from the front.
Figure 2B:
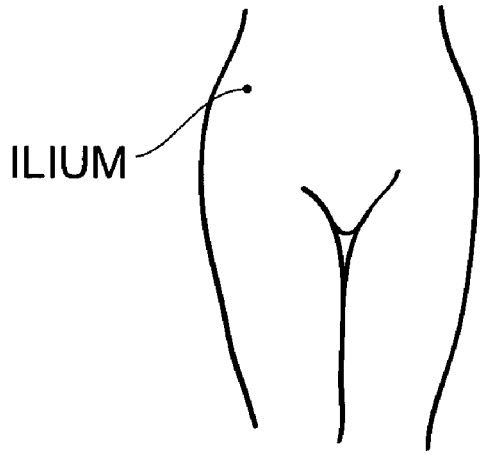
FIG. 2B is a view showing the external form of the body shown in FIG. 2A.
Figure 2C:
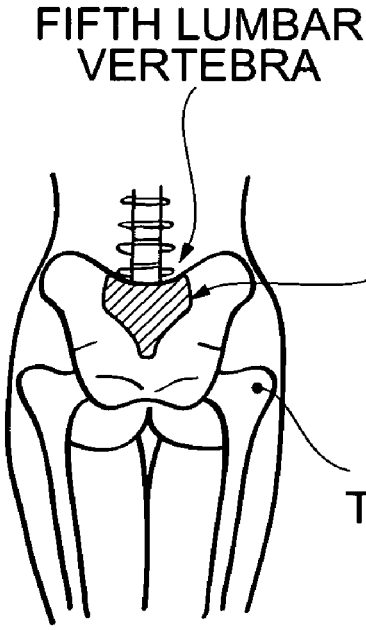
FIG. 2C is a view showing a skeleton for the case of viewing a body from the rear.
Figure 2D:
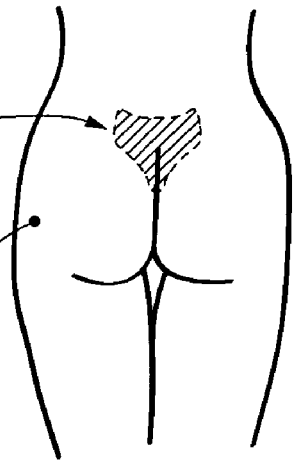
FIG. 2D is a view showing the external form of the body shown in FIG. 2C.

Following is a description of embodiments of the present invention with reference to the drawings. Note that elements that are the same as one another are given the same reference numeral, and redundant repeated description will be omitted.

Figure 3A:
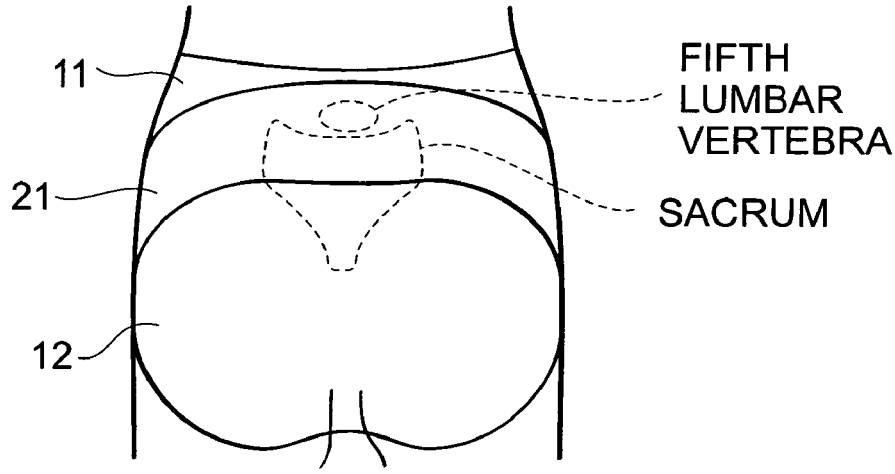
FIG. 3A is a view from the rear of a state in which a girdle of an embodiment is being worn.
Figure 3B:
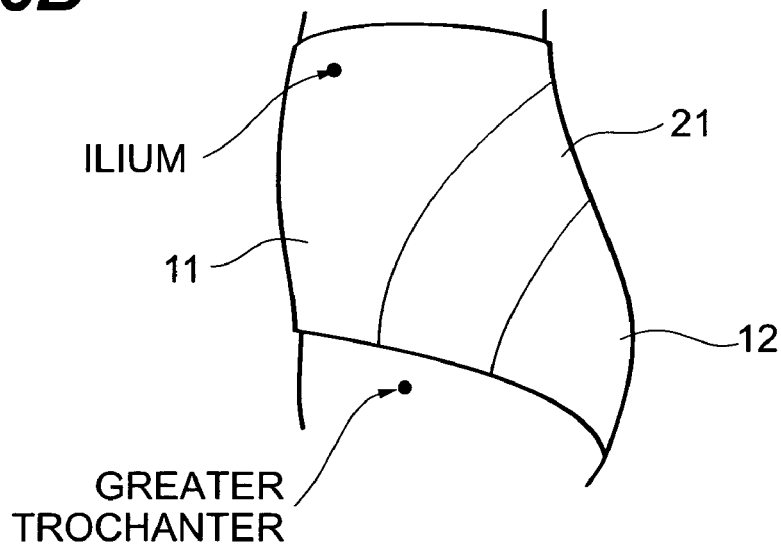
FIG. 3B is a view from the side of the state in which the girdle of the embodiment is being worn.

FIGS. 3A and 3B show a crotch-possessing corrective garment (short type girdle) according to an embodiment; FIG. 3A is a view from the rear of a state in which the girdle is being worn, and FIG. 3B is a view from the side. This girdle is formed by sewing together a front waste fabric portion 11 that fits over the front of the lower abdomen of the wearer, a hip fabric portion 12 that fits over the buttocks, a crotch fabric portion (not shown) that fits over the crotch, and a tightening fabric portion 21 that similarly fits over the body (lumbar region) of the wearer. In this way, the tightening fabric portion 21, which applies a tightening force to the lumbar region of the wearer, is provided in an area suitably fitting over the lumbar region so as to form a constituent element of the garment (girdle) itself, and hence handling is easy, and there is no detriment to the feeling when worn.

When the garment is being worn, the tightening fabric portion 21 forms a belt shape having an approximately constant width that runs from above the anal cleft, passing above the left and right buttocks, to the vicinities of the left and right greater trochanters. Moreover, the tightening fabric portion 21 is formed from a fabric for which the magnitude of the tightening force varies with direction, with the tightening force being strong (i.e. stretching being difficult) in one direction, and the tightening force being weak (i.e. stretching being easy) in the direction orthogonal thereto.

That is, the tightening force possessed by the tightening fabric portion 21 is weak in the direction in which the tightening fabric portion 21 runs (the longitudinal direction of the belt shape), and is strong in the direction orthogonal thereto (the width direction of the belt shape). Moreover, when the garment is being worn, the tightening fabric portion 21 is curved in a shape that is upwardly convex, and as shown in FIG. 3A, an uppermost part of the tightening fabric portion 21 fits above the anal cleft (in a position at the top of the sacrum, or a position at the fifth lumbar vertebra).

Figure 4:
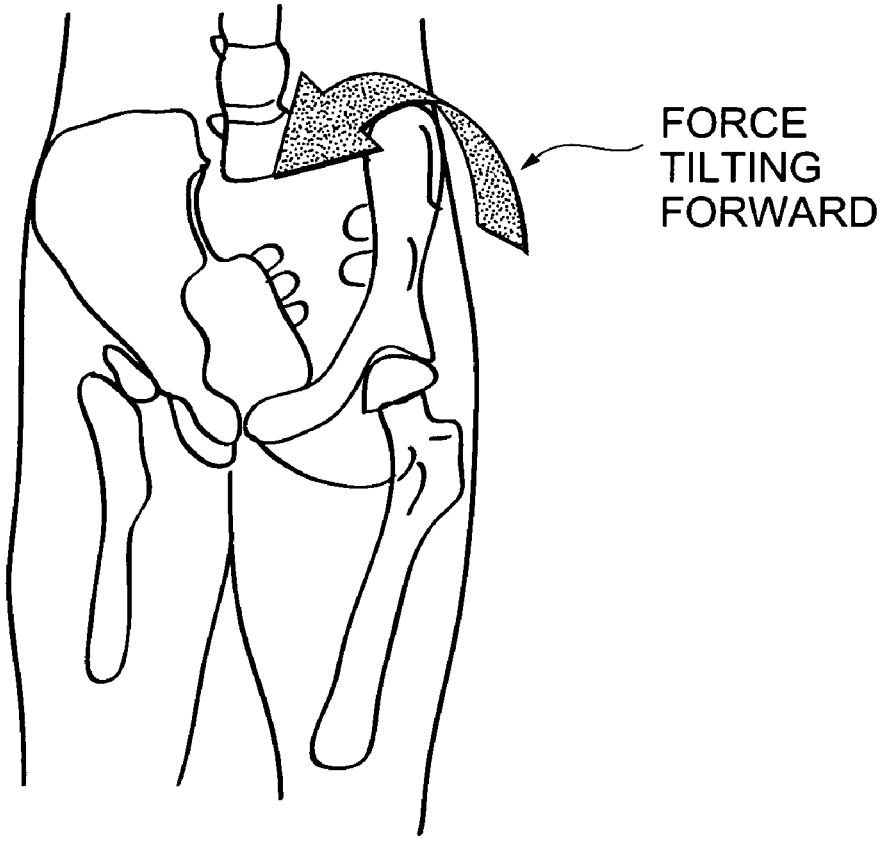
FIG. 4 is a view for explaining the functioning of the embodiment from the skeleton in the lumbar region of the body.

According to the short girdle of the present embodiment, when the girdle is being worn, the tightening fabric portion 21, which runs from above the anal cleft, passing above the left and right buttocks, to the vicinities of the left and right greater trochanters is constituted such that the tightening force in the direction in which the tightening fabric portion 21 runs is low, and hence the tightening fabric portion 21 has an action of supporting the piriform muscles and pushing a somewhat upper part of the sacrum from the rear. That is, a strong tightening force acts in a direction orthogonal to the belt-shaped line running from above the anal cleft, passing above the left and right buttocks, to the vicinities of the left and right greater trochanters, and hence the fabric of the girdle over the buttocks is somewhat stretched and the tension in the fabric at the flanks is increased, and thus a force that pushes the backside out and a force that makes the wearer's legs turn inward are generated. That is, as shown by the arrow in FIG. 4, a force that tilts the pelvis forward acts, and hence an effect of improving the posture is produced.

Figure 5:
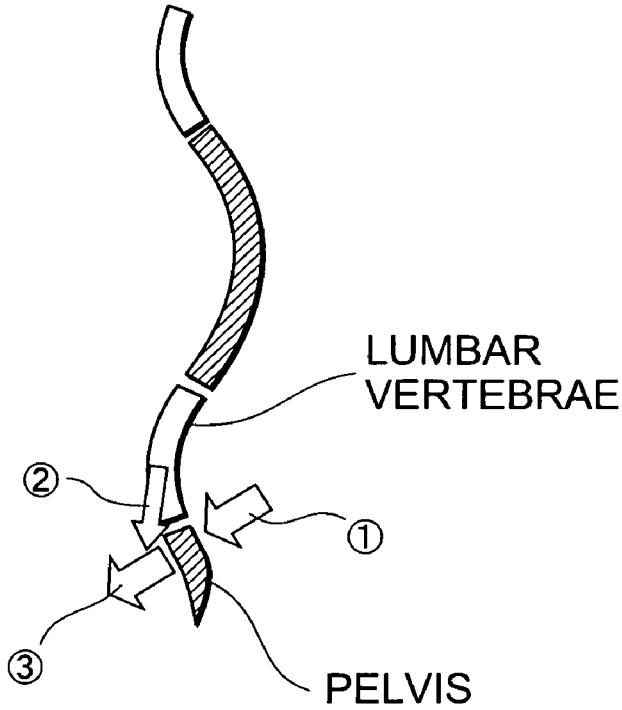
FIG. 5 is a view for explaining the functioning of the embodiment schematically.

FIG. 5 explains this action schematically. A force that supports the piriform muscles and pushes (a somewhat upper part of) the sacrum from the rear (arrow (1) in FIG. 5) acts, and a force that supports the iliopsoas muscles and increases the forward curvature of the lumbar vertebra (arrow (2) in FIG. 5) acts, and as a result a force that rotates the lumbar region forward (arrow (3) in FIG. 5) is produced. As a result, the posture of the whole body is improved.

Note that there are three possible specific constitutions of the tightening portion, i.e. firstly a constitution in which the tightening portion is stuck onto the fabric of the main body of the garment, secondly a constitution in which a fabric having a strong tightening force and a fabric having a weak tightening force are joined together, and thirdly a constitution in which the power is changed in a single piece of fabric through knitting (circular knitting or warp knitting). As an example, with warp knitting, the tightening portion can be produced with a single raschel jacquard, tricot jacquard or double raschel jacquard fabric with an area having strong power provided by curving the jacquard pattern into a belt shape. Moreover, the tightening portion can be made to be such that the tightening force is strongest in the vicinity of the greater trochanters and gradually weakens in the direction in which the tightening portion runs.

Figure 6A:
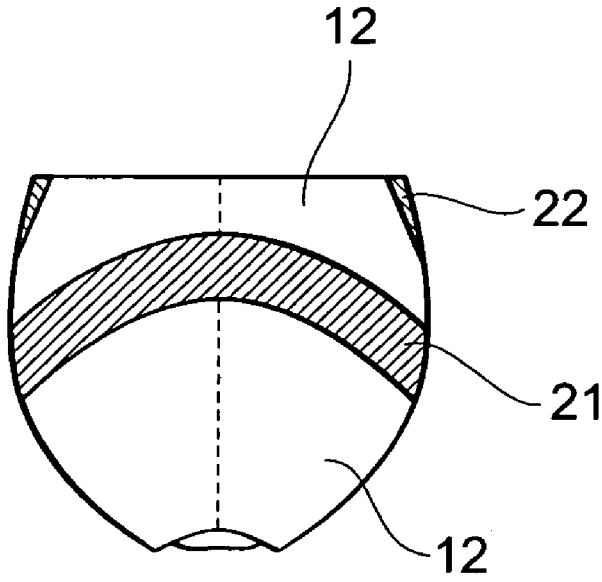
FIG. 6A is a view from the rear of a state in which a short girdle according to an embodiment is being worn.
Figure 6B:
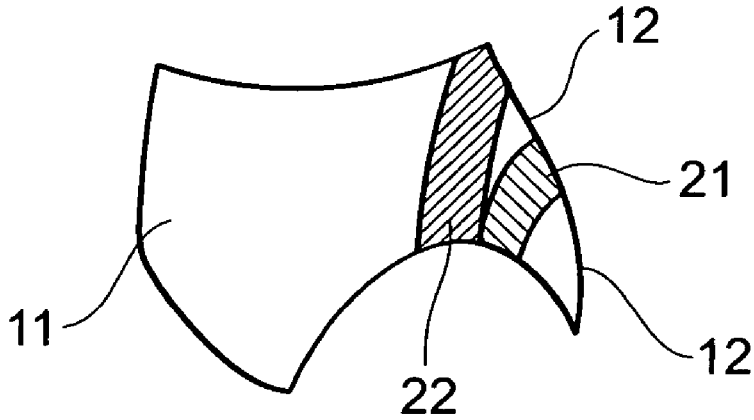
FIG. 6B is a view diagonally from the side of the state in which the short girdle according to the embodiment is being worn.

FIGS. 6A and 6B show a short type girdle according to another embodiment; FIG. 6A is a view from the rear of a state in which the girdle is being worn, and FIG. 6B is a view diagonally from the side. This girdle has a front waste fabric portion 11, a hip fabric portion 12 and a crotch fabric portion (not shown), and moreover in addition to a tightening fabric portion 21 as in the embodiment of FIGS. 3A and 3B, also has a left/right pair of supplementary tightening fabric portions 22, and is constituted through these portions being sewn together.

Each of the supplementary tightening fabric portions 22 is positioned in front of the tightening fabric portion 21 in the lumbar region on the left or the right, and is provided so as to run in an up/down direction (a direction slightly inclined such that the flank side is slightly behind the lower edge side) alongside the tightening fabric portion 21 when the girdle is being worn. Moreover, with each of these supplementary tightening fabric portions 22, the strength of the tightening force again has directionality, with the tightening force in the direction in which the supplementary tightening fabric portion 22 runs (the up/down direction) being made to be lower than the tightening force in the direction orthogonal thereto (the front/back direction). The supplementary tightening fabric portions 22 thus suitably act on the iliopsoas muscles and increase the forward curvature of the lumbar vertebra, whereby the action of tilting the pelvis forward and thus improving the posture can be improved.

According to the present embodiment, the tightening fabric portion 21 which is positioned at the rear of the lumbar region when the girdle is being worn, and the left/right pair of supplementary tightening fabric portions 22 which are positioned at the front of the lumbar region can be constituted from different materials. As a result, the magnitudes and directions of the tightening forces acting on the piriform muscles and the iliopsoas muscles can be set separately and suitably.

Figure 7A:
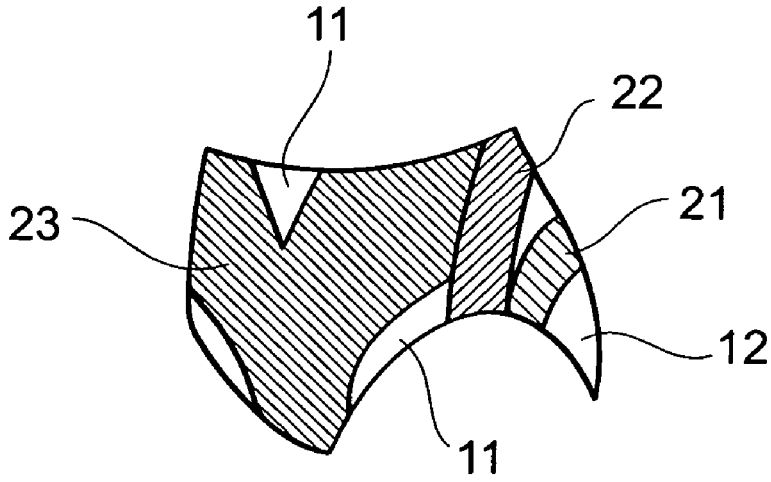
FIG. 7A is a view diagonally from the side of a state in which a short girdle according to another embodiment is being worn.
Figure 7B:
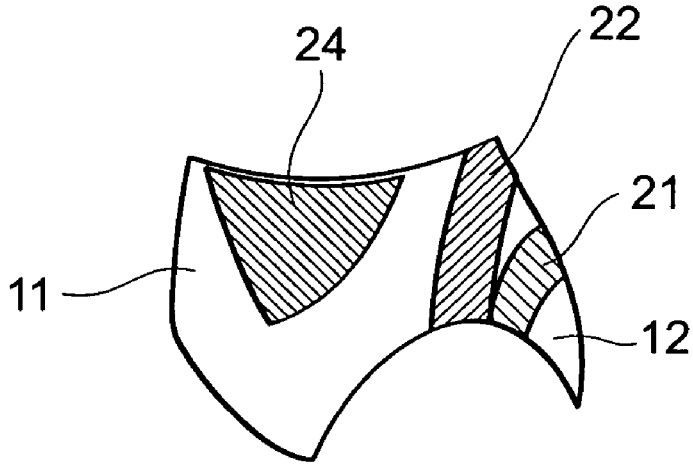
FIG. 7B is a view diagonally from the side of a state in which a short girdle according to another embodiment is being worn.

FIGS. 7A and 7B show variations of the girdle according to the embodiment of FIGS. 6A and 6B; each of FIGS. 7A and 7B is a view diagonally from the side of a state in which the short girdle according to the respective variation is being worn. Note that the constitution of the rear and the sides is as in FIG. 5, with the tightening fabric portion 21 and the supplementary tightening fabric portions 22 being included as elements of the main body of the garment (elements that fit over the lumbar region of the wearer).

The girdle of FIG. 7A has a body front tightening fabric portion 23 on the front waste fabric portion 11, with this supporting the external oblique muscles. This body front tightening fabric portion 23 is constituted from a material having a tightening force, and has an approximate V-shape running from the front center (above the crotch) upward to the left and right when the girdle is being worn. The girdle of FIG. 7B has an approximately triangular body front tightening fabric portion 24 on an upper part of the front waste fabric portion 11. This body front tightening fabric portion 24 is constituted from a material having a tightening force, and supports the external oblique muscles.

Figure 8:
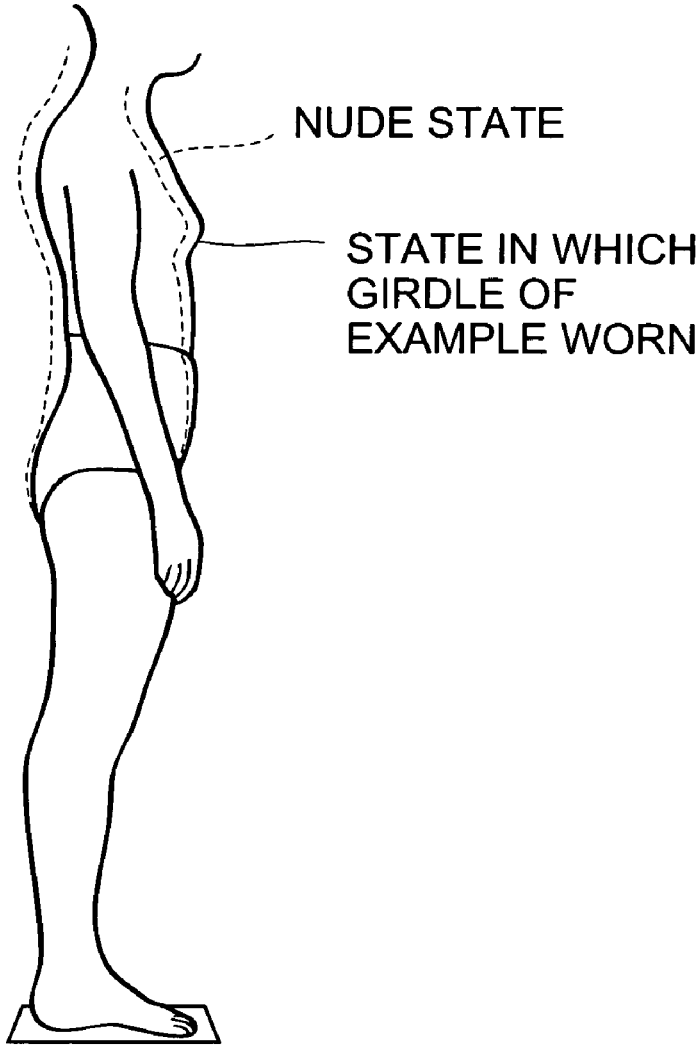
FIG. 8 is a view for explaining the posture correction effect of a short girdle according to an embodiment.

FIG. 8 shows the posture improving effect of a short girdle to which the present invention is applied; the dashed line shows the posture of a monitor in a nude state, and the full line shows the posture of the monitor when wearing the girdle. It can be seen from FIG. 8 that a posture that tends to be tilted back (or upright) is greatly improved. Moreover, when wearing such a short girdle, not only is the posture corrected, but moreover there also effects such as movement of the lower half of the body becoming smooth, and the hip joints being positioned properly so that the stride when walking is extended.

As in the embodiments of the present invention, supporting the piriform muscles along a line joining from the tops of the left and right femurs, passing over the upper parts of the left and right hips, to above the anal cleft (the line of the tightening fabric portion 21) is essential for improving the posture, and next if the iliopsoas muscles are supported along lines each starting at the bottom from slightly in front of a center-line on a side of the body and finishing at the top slightly behind this center-line (the lines of the supplementary tightening fabric portions 22), then the effect of improving the posture is improved, or alternatively if the external oblique muscles are supported primarily along lines that spread out from the front center over the front of the abdomen diagonally upward to the flanks (the lines of the body front tightening fabric portion 23 or 24), then the posture can again be further improved.

The present invention is not limited to the embodiments and variations described above, but rather various other forms as shown in FIGS. 9 to 26 are also possible.

Figure 9A:
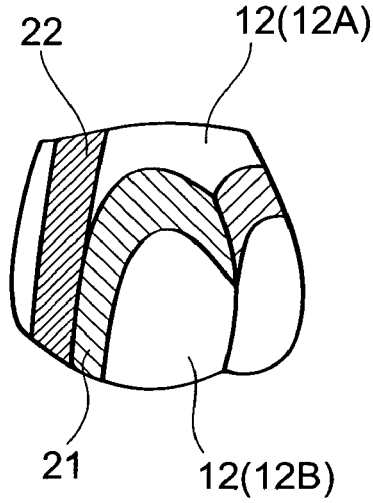
FIG. 9A is a rear perspective view of a short girdle showing a first variation of an embodiment.
Figure 9B:
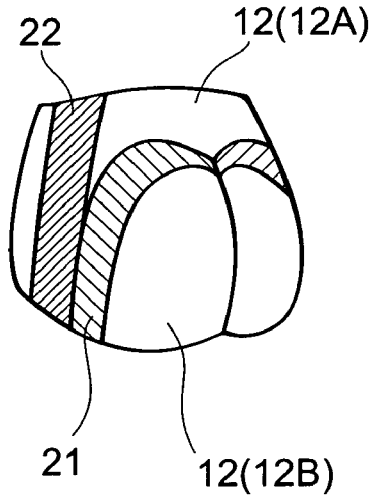
FIG. 9B is a rear perspective view of a short girdle showing the first variation of the embodiment.
Figure 9C:
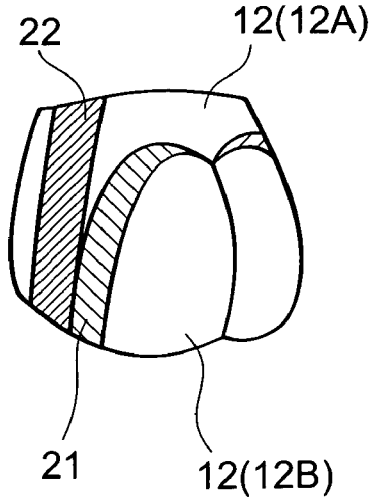
FIG. 9C is a rear perspective view of a short girdle showing the first variation of the embodiment.

FIGS. 9A to 9C are perspective views from the rear of short type girdles according to a first variation of an embodiment. With the girdle of FIG. 9A, each of a left/right pair of supplementary tightening fabric portions 22 is positioned in front of a tightening fabric portion 21 in the lumbar region on the left or the right, and the tightening fabric portions 21 are constituted so as to have an approximately constant width up to above the anal cleft. With the girdle of FIG. 9B, each of the left/right pair of tightening fabric portions 21 is constituted so as to narrow in the vicinity of above the anal cleft, and with the girdle of FIG. 9C, each of the left/right pair of tightening fabric portions 21 is constituted so as to narrow before above the anal cleft. Moreover, in each of these cases, there is a front waste fabric portion 11 in front of the supplementary tightening fabric portions 22, and a hip fabric portion 12 is divided into an upper part 12A above the supplementary tightening fabric portions 22 and a lower part 12B below the supplementary tightening fabric portions 22.

Figure 10:
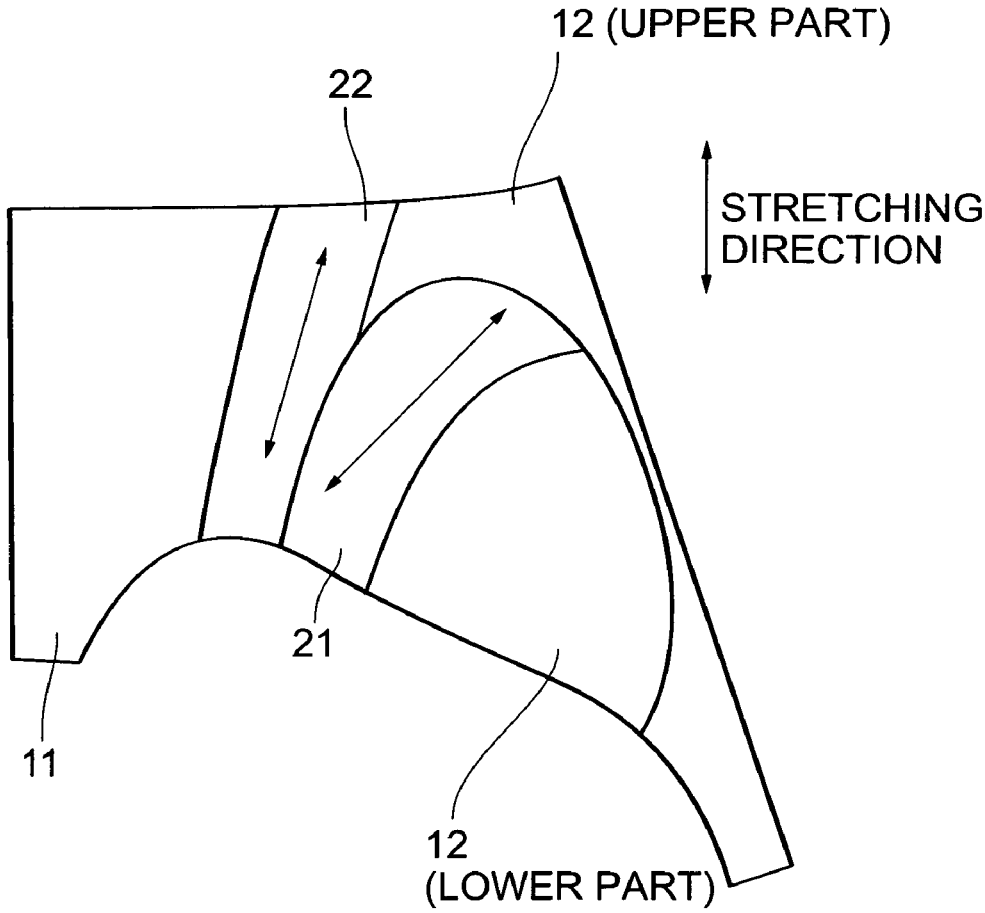
FIG. 10 is a plan view of a paper pattern for the short girdle of FIGS. 9A to 9C.

FIG. 10 shows a paper pattern for FIG. 9A (left half). The arrows are the directions in which the tightening fabric portion 21 and the supplementary tightening fabric portion 22 stretch (the direction in which the tightening force is weak). Note that regarding the direction in which the front waste fabric portion 11 and the top/bottom-divided hip fabric portion 12 stretch (the direction in which the tightening force is weak), there is no directional dependence. According to the variation of FIGS. 9A to 9C and 10, the tightening fabric portions 21 and the supplementary tightening fabric portions 22 can be constituted from different materials, and hence the magnitudes and directions of the tightening forces acting on the piriform muscles and the iliopsoas muscles can be set separately and suitably; in this sense, the effect of improving the posture is particularly excellent.

Figure 11A:
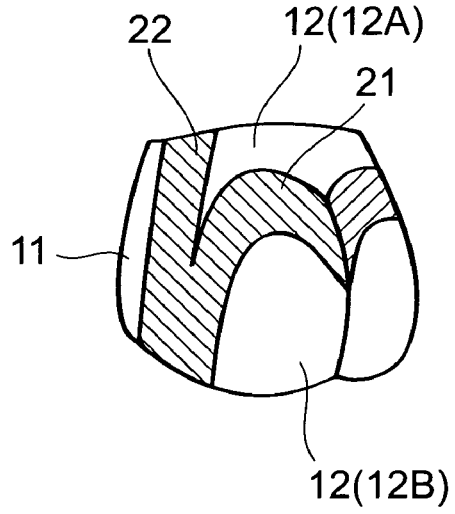
FIG. 11A is a rear perspective view of a short girdle showing a second variation of the embodiment.
Figure 11B:
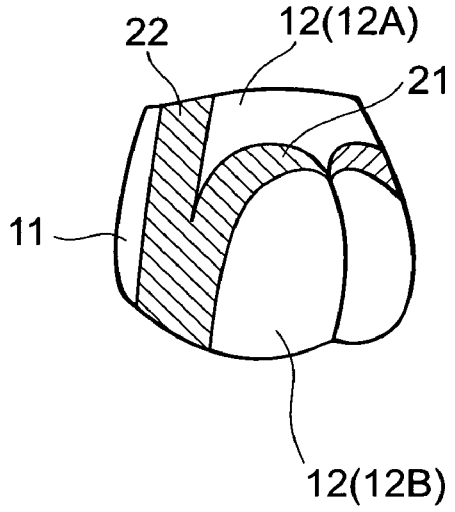
FIG. 11B is a rear perspective view of a short girdle showing the second variation of the embodiment.
Figure 11C:
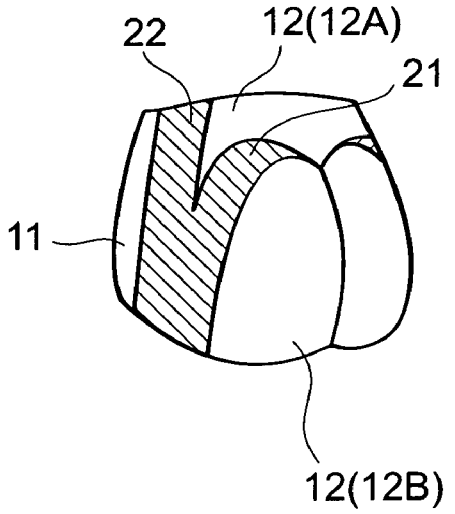
FIG. 11C is a rear perspective view of a short girdle showing the second variation of the embodiment.

FIGS. 11A to 11C are perspective views from the rear of short type girdles according to a second variation of the embodiment. In each of the cases, each tightening fabric portion 21 and the supplementary tightening fabric portion 22 thereinfront are integrated together in the vicinity of the greater trochanter (on the lower edge side); with the girdle of FIG. 11A, each of the left/right pair of tightening fabric portions 21 is constituted so as to have an approximately constant width up to above the anal cleft, with the girdle of FIG. 11B, each of the tightening fabric portions 21 is constituted so as to narrow in the vicinity of above the anal cleft, and with the girdle of FIG. 11C, each of the tightening fabric portions 21 is constituted so as to narrow before above the anal cleft. Moreover, in each of the cases, there is a front waste fabric portion 11 in front of the supplementary tightening fabric portions 22, and the hip fabric portion 12 is divided into an upper part 12A above the supplementary tightening fabric portions 22 and a lower part 12B below the supplementary tightening fabric portions 22.

The direction in which each of the tightening fabric portions 21 and the supplementary tightening fabric portions 22 stretches (the direction in which the tightening force is weak) approximately coincides with the direction in which the tightening fabric portion 21 or supplementary tightening fabric portion 22 runs, and hence there is an effect of improving the posture. Note, however, that the tightening fabric portions 21 and the supplementary tightening fabric portions 22 are made of the same material due to being integrated together on the lower edge side, and hence separately setting the magnitudes and directions of the tightening forces is difficult.

Figure 12A:
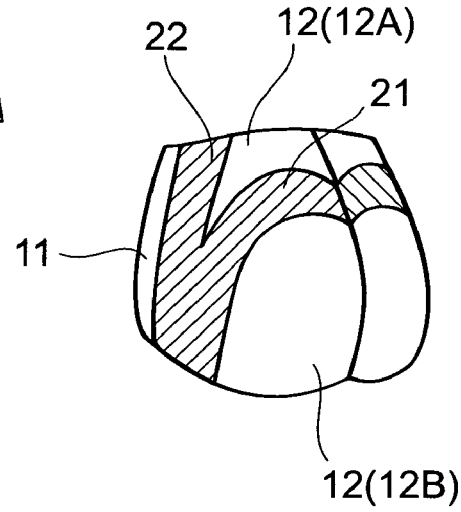
FIG. 12A is a rear perspective view of a short girdle showing a third variation of the embodiment.
Figure 12B:
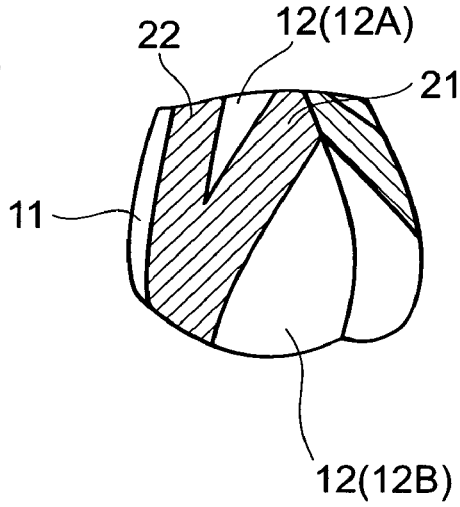
FIG. 12B is a rear perspective view of a short girdle showing the third variation of the embodiment.
Figure 12C:
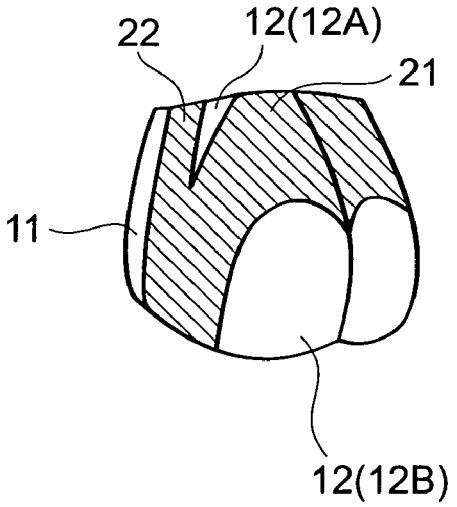
FIG. 12C is a rear perspective view of a short girdle showing the third variation of the embodiment.
Figure 13A:
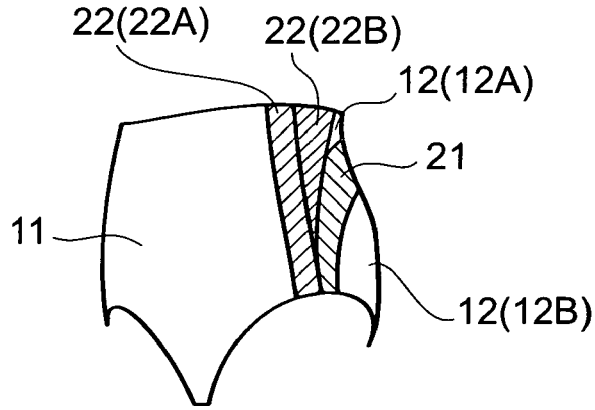
FIG. 13A is a rear perspective view of a short girdle showing a fourth variation of the embodiment.
Figure 13B:
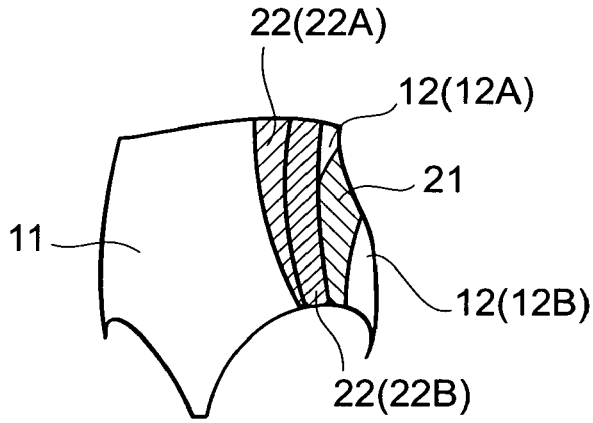
FIG. 13B is a rear perspective view of a short girdle showing the fourth variation of the embodiment.
Figure 13C:
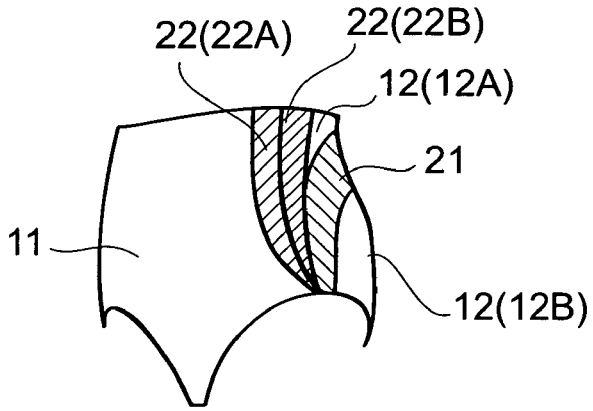
FIG. 13C is a rear perspective view of a short girdle showing the fourth variation of the embodiment.
Figure 13D:
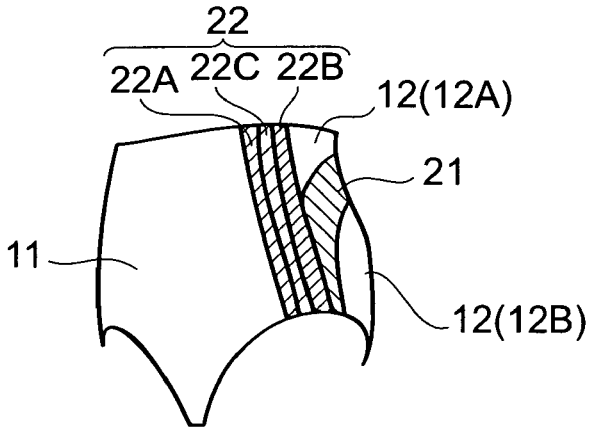
FIG. 13D is a rear perspective view of a short girdle showing the fourth variation of the embodiment.
Figure 14A:
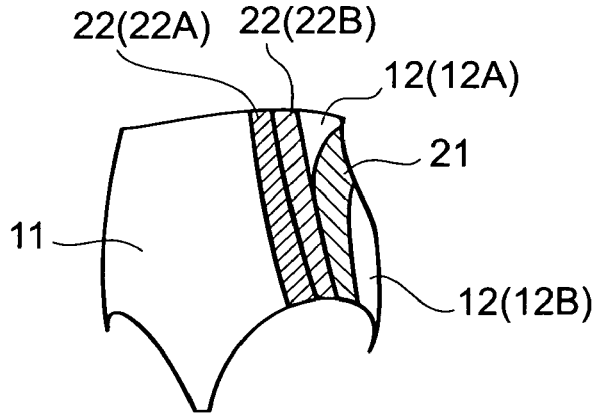
FIG. 14A is a front perspective view of a short girdle showing a fifth variation of the embodiment.
Figure 14B:
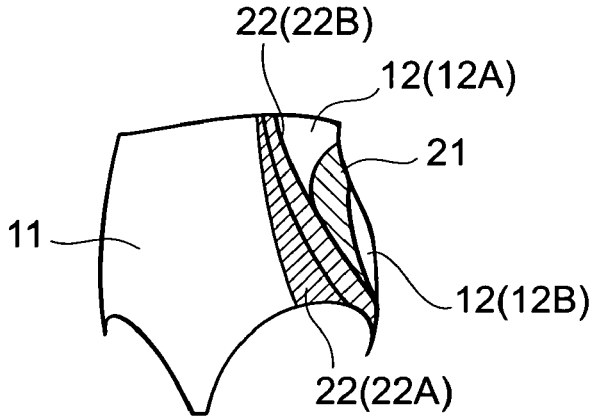
FIG. 14B is a front perspective view of a short girdle showing the fifth variation of the embodiment.
Figure 14C:
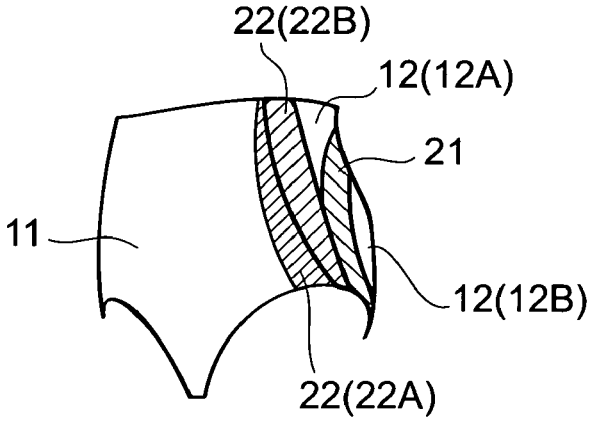
FIG. 14C is a front perspective view of a short girdle showing the fifth variation of the embodiment.
Figure 14D:
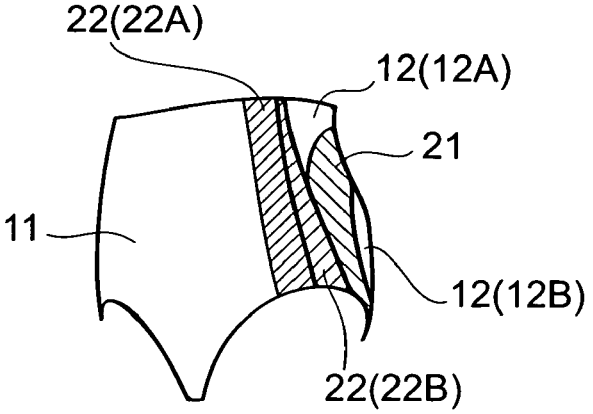
FIG. 14D is a front perspective view of a short girdle showing the fifth variation of the embodiment.

FIGS. 12A to 12C are perspective views from the rear of short type girdles according to a third variation of the embodiment. In each of the cases, there is a front waste fabric portion 11 in front of the supplementary tightening fabric portions 22, and the hip fabric portion 12 is divided into an upper part 12A above the tightening fabric portions 21 and a lower part 12B below the tightening fabric portions 21. Moreover, each tightening fabric portion 21 and the supplementary tightening fabric portion 22 thereinfront are integrated together on the lower edge side.

With the girdle of FIG. 12A, each of the left/right pair of tightening fabric portions 21 is smoothly curved so as to be upwardly convex, and is constituted so as to have an approximately constant width up to above the anal cleft. With the girdle of FIG. 12B, each of the tightening fabric portions 21 is constituted so as to be approximately straight and to have an approximately constant width up to above the anal cleft. With the girdle of FIG. 12C, each of the tightening fabric portions 21 is constituted so as to broaden before reaching above the anal cleft, and is thus constituted so as cover a broad area of the upper part of the wearer's buttock. In these cases, again the direction in which each of the tightening fabric portions 21 and the supplementary tightening fabric portions 22 stretches (the direction in which the tightening force is weak) approximately coincides with the direction in which the tightening fabric portion 21 or supplementary tightening fabric portion 22 runs, and hence there is an effect of improving the posture. Note, however, that the tightening fabric portions 21 and the supplementary tightening fabric portions 22 are made of the same material, and hence separately setting the magnitudes and directions of the tightening forces is difficult.

FIGS. 13A to 13D are perspective views from the rear of short type girdles according to a fourth variation of the embodiment. In each of the cases, there is a front waste fabric portion 11 in front of the tightening fabric portions 22, and the hip fabric portion 12 behind the tightening fabric portions 22. Compared with the third variation of FIGS. 12A to 12C, a characteristic feature is that the tightening fabric portion covering each buttock and the supplementary tightening fabric portion covering each flank are integrated together so as to form a broad tightening fabric portion 20. In these cases, again the direction in which each of the tightening fabric portions 20 stretches (the direction in which the tightening force is weak) approximately coincides with the direction in which the tightening fabric portion 20 runs, and hence the tightening fabric portions 20 act on the piriform muscles and the iliopsoas muscles and thus there is an effect of improving the posture.

FIGS. 14A to 14D are perspective views from the front of short type girdles according to a fifth variation of the embodiment. In each of the cases, for each tightening fabric portion 22, a front part 22A and a rear part 22B are made of different materials, there is a front waste fabric portion 11 in front of the front tightening fabric portions 22A, and the hip fabric portion 12 behind is divided into an upper part 12A above the tightening fabric portions 21 and a lower part 12B below the tightening fabric portions 21. The difference between FIGS. 14A to 14D is the shape of the front part 22A and the rear part 22B of each tightening fabric portion 22; in FIG. 14A both have the same shape having the same width at the top and the bottom, in FIG. 14B both have a shape that is broader at the bottom, in FIG. 14C the front part 22A has a shape that is broader at the bottom and the rear part 22B has a shape having the same width at the top and the bottom, and in FIG. 14D the front part 22A has a shape having the same width at the top and the bottom and the rear part 22B has a shape that is broader at the bottom.

In the case of this fifth variation, again the front part 22A and the rear part 22B of each supplementary tightening fabric portion 22 can be made of different materials, and hence the magnitudes and directions of the tightening forces can be set separately. Moreover, the direction in which each of the tightening fabric portions 20 and the supplementary tightening fabric portions 22 (22A, 22B) stretches (the direction in which the tightening force is weak) approximately coincides with the direction in which the tightening fabric portion 20 or supplementary tightening fabric portion 22 runs, and hence the tightening fabric portions 20 and the supplementary tightening fabric portions 22 act on the piriform muscles and the iliopsoas muscles and thus there is an effect of improving the posture.

FIGS. 15A to 15D are perspective views from the front of short type girdles according to a sixth variation of the embodiment. In each of the cases, for each supplementary tightening fabric portion 22, a front part 22A and a rear part 22B are made of different materials, there is a front waste fabric portion 11 in front of the front supplementary tightening fabric portions 22A, and the hip fabric portion 12 behind is divided into an upper part 12A above the tightening fabric portions 21 and a lower part 12B below the tightening fabric portions 21.

Figure 15A:
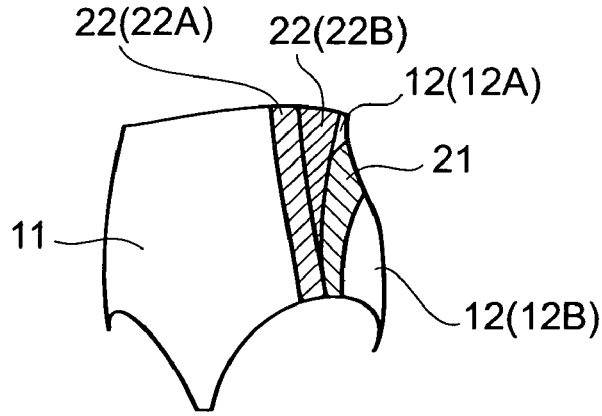
FIG. 15A is a front perspective view of a short girdle showing a sixth variation of the embodiment.
Figure 15B:
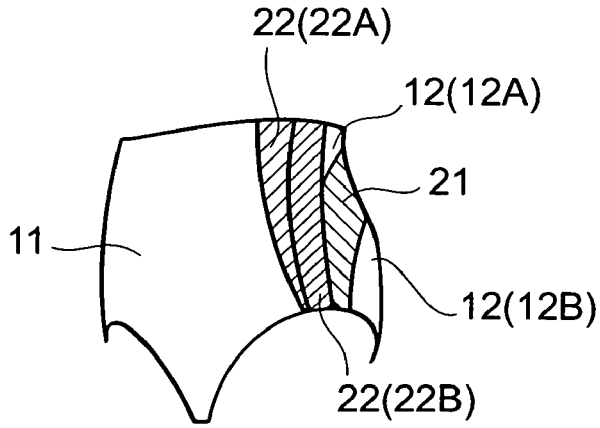
FIG. 15B is a front perspective view of a short girdle showing the sixth variation of the embodiment.
Figure 15C:
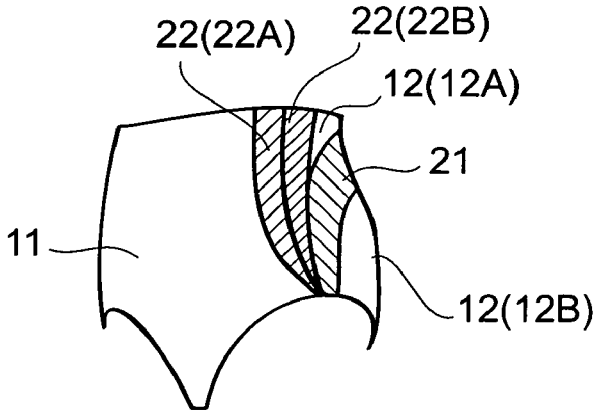
FIG. 15C is a front perspective view of a short girdle showing the sixth variation of the embodiment.
Figure 15D:
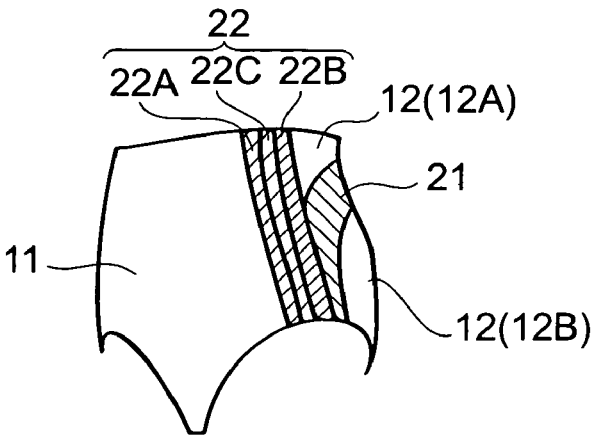
FIG. 15D is a front perspective view of a short girdle showing the sixth variation of the embodiment.

The difference between FIGS. 15A to 15D is the shape of the front part 22A and the rear part 22B of each tightening fabric portion 22; in FIG. 15A the front part 22A has a shape having the same width at the top and the bottom and the rear part 22B has a shape that is broader at the top, in FIG. 15B the front part 22A has a shape that is broader at the top and the rear part 22B has a shape having the same width at the top and the bottom, in FIG. 15C both have a shape that is broader at the top, and in FIG. 15D there is a middle part 22C between the front part 22A and the rear part 22B and each of the three parts has the same shape having the same width at the top and the bottom.

In the case of this sixth variation, again the front part 22A and the rear part 22B (and the middle part 22C) of each supplementary tightening fabric portion 22 are made of different materials, and hence the magnitudes and directions of the tightening forces can be set separately. Moreover, the direction in which each of the tightening fabric portions 21 and the supplementary tightening fabric portions 22 (22A, 22B, 22C) stretches (the direction in which the tightening force is weak) approximately coincides with the direction in which the tightening fabric portion 21 or supplementary tightening fabric portion 22 runs, and hence the tightening fabric portions 21 and the supplementary tightening fabric portions 22 act on the piriform muscles and the iliopsoas muscles and thus there is an effect of improving the posture.

Figure 16A:
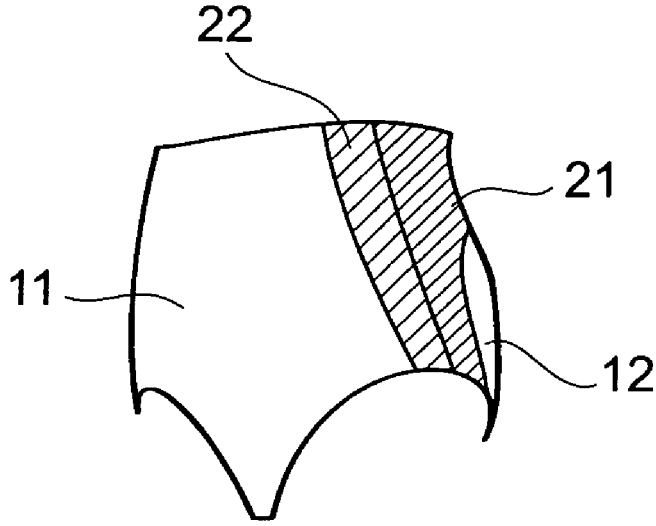
FIG. 16A is a front perspective view of a short girdle showing a seventh variation of the embodiment.
Figure 16B:
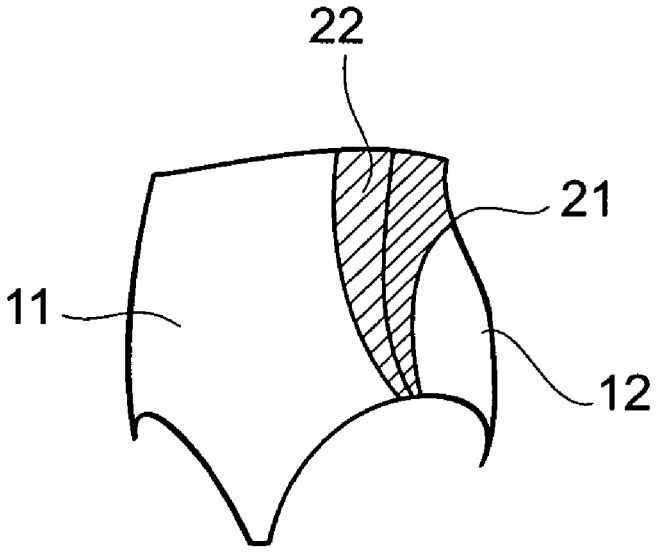
FIG. 16B is a front perspective view of a short girdle showing the seventh variation of the embodiment.
Figure 16C:
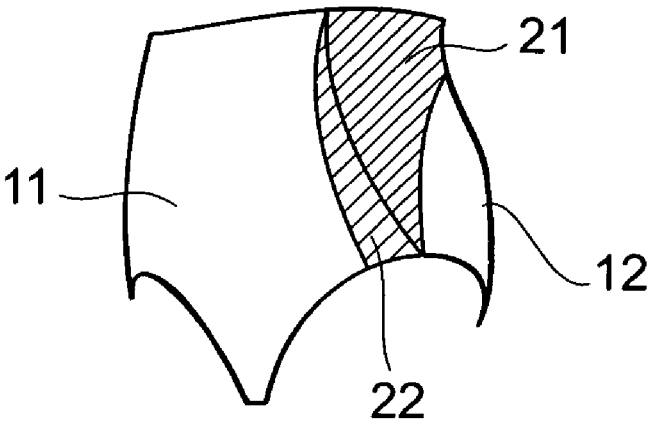
FIG. 16C is a front perspective view of a short girdle showing the seventh variation of the embodiment.

FIGS. 16A to 16C are perspective views from the front of short type girdles according to a seventh variation of the embodiment. In each of the cases, the tightening fabric portion 21 covering each buttock of the wearer and the supplementary tightening fabric portion 22 covering each flank are provided contacting one another, there is a front waste fabric portion 11 in front of the supplementary tightening fabric portions 22, and there is a hip fabric portion 12 behind the tightening fabric portions 21.

The difference between FIGS. 16A to 16C is the shape of the supplementary tightening fabric portion 22 in front of and contacting each tightening fabric portion 21; in FIG. 16A each supplementary tightening fabric portion 22 has a shape having the same width at the top and the bottom, in FIG. 16B each supplementary tightening fabric portion 22 has a shape that is broader at the top, and in FIG. 16C each supplementary tightening fabric portion 22 has a shape that is broader at the bottom. In the case of this seventh variation, again the direction in which each of the tightening fabric portions 21 and the supplementary tightening fabric portions 22 stretches approximately coincides with the direction in which the tightening fabric portion 21 or supplementary tightening fabric portion 22 runs, and hence the tightening fabric portions 21 and the supplementary tightening fabric portions 22 act on the piriform muscles and the iliopsoas muscles and thus there is an effect of improving the posture.

Figure 17A:
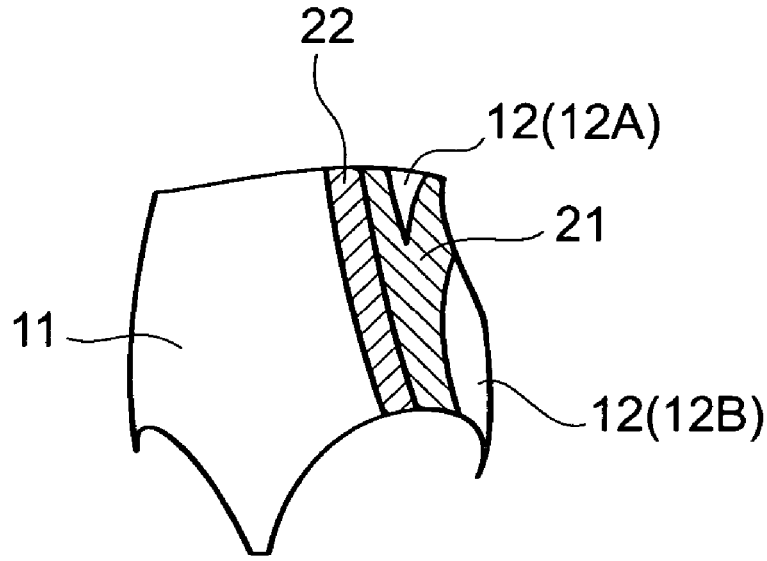
FIG. 17A is a front perspective view of a short girdle showing an eighth variation of the embodiment.
Figure 17B:
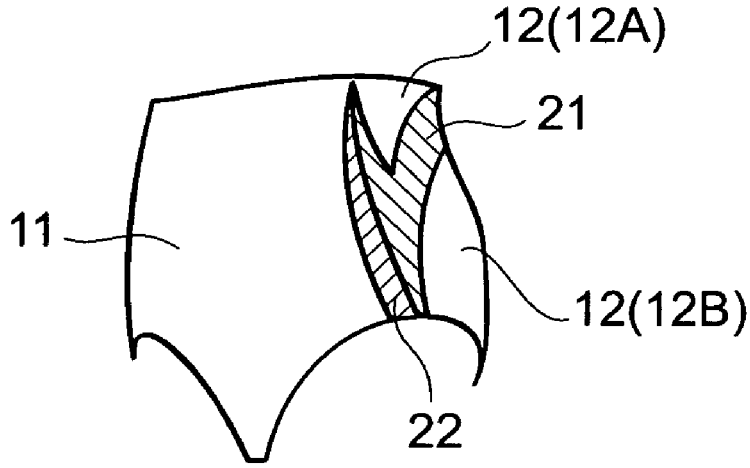
FIG. 17B is a front perspective view of a short girdle showing the eighth variation of the embodiment.
Figure 17C:
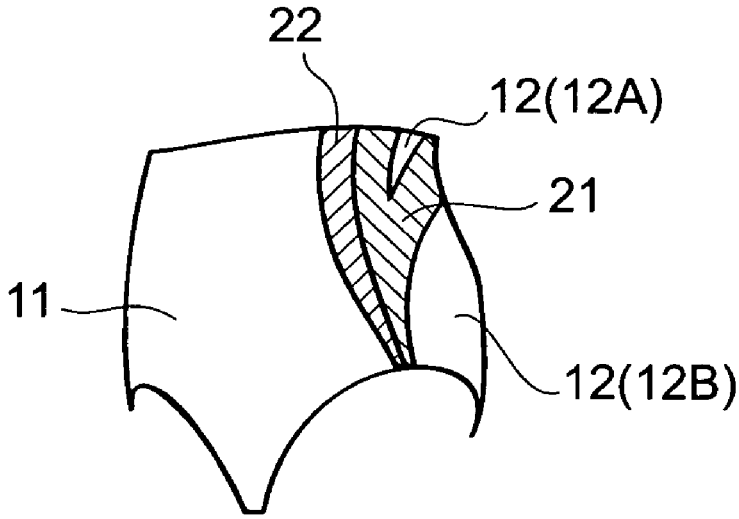
FIG. 17C is a front perspective view of a short girdle showing the eighth variation of the embodiment.

FIGS. 17A to 17C are perspective views from the front of short type girdles according to an eighth variation of the embodiment. In each of the cases, the tightening fabric portion 21 covering each buttock of the wearer and the supplementary tightening fabric portion 22 covering each flank are provided contacting one another, there is a front waste fabric portion 11 in front of the supplementary tightening fabric portions 22, and there is a hip fabric portion 12 behind the tightening fabric portions 21. The difference to the seventh variation of FIG. 16 is that when the girdle is being worn each of the tightening fabric portions 21 for covering the buttocks is forked into two at the top.

The difference between FIGS. 17A to 17C is the shape of the tightening fabric portions 21 and the supplementary tightening fabric portions 22. In FIG. 17A, for each of the tightening fabric portions 21, the two forks at the top on the flank have a shape having an approximately constant width, and each of the supplementary tightening fabric portions 22 has a shape having the same width at the top and the bottom. In FIG. 17B, the front fork of each tightening fabric portion 21 is pointed and the rear fork has a shape having an approximately constant width, and each of the supplementary tightening fabric portions 22 has a shape that is pointed at the top. In FIG. 17C, for each of the tightening fabric portions 21, the two forks at the top have a shape having an approximately constant width, and each of the supplementary tightening fabric portions 22 has a shape that is broader at the top. In the case of this eighth variation, again the direction in which each of the tightening fabric portions 21 and the supplementary tightening fabric portions 22 stretches (the direction in which the tightening force is weak) approximately coincides with the direction in which the tightening fabric portion 21 or supplementary tightening fabric portion 22 runs, and hence the tightening fabric portions 21 and the supplementary tightening fabric portions 22 act on the piriform muscles and the iliopsoas muscles and thus there is an effect of improving the posture.

Figure 18A:
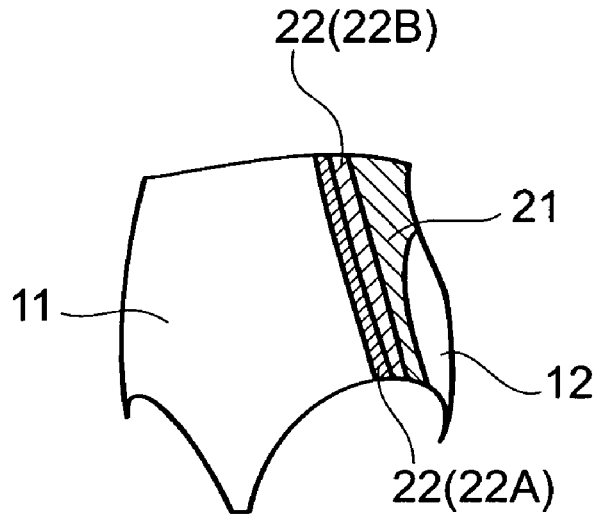
FIG. 18A is a front perspective view of a short girdle showing a ninth variation of the embodiment.
Figure 18B:
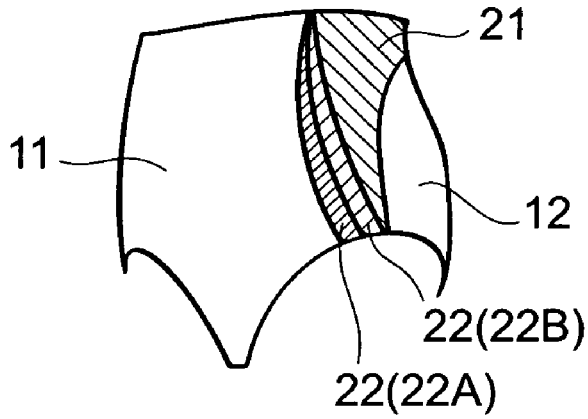
FIG. 18B is a front perspective view of a short girdle showing the ninth variation of the embodiment.
Figure 18C:
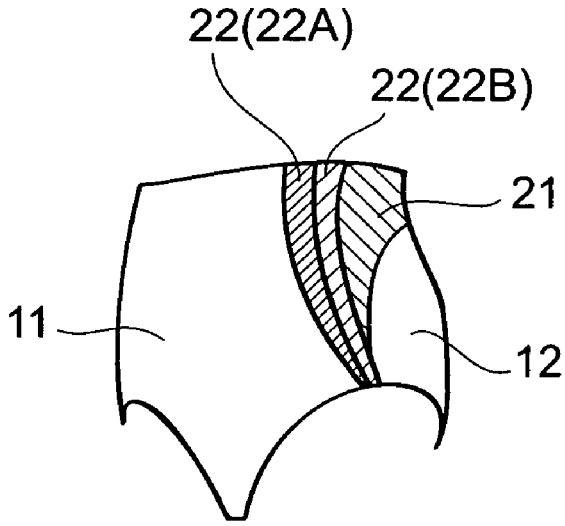
FIG. 18C is a front perspective view of a short girdle showing the ninth variation of the embodiment.

FIGS. 18A to 18C are perspective views from the front of short type girdles according to a ninth variation of the embodiment. In each of the cases, the tightening fabric portion 21 covering each buttock of the wearer and the supplementary tightening fabric portion 22 covering each flank are provided contacting one another, there is a front waste fabric portion 11 in front of the supplementary tightening fabric portions 22, and there is a hip fabric portion 12 behind the tightening fabric portions 21. The difference to the eighth variation of FIG. 16 is that each of the supplementary tightening fabric portions 22 that fit over the flanks is constituted from parts 22A and 22B that are at the front and the rear respectively when the girdle is being worn.

The difference between FIGS. 18A to 18C is the shape of the front and rear supplementary tightening fabric parts 22A and 22B. In FIG. 18A the front and rear parts 22A and 22B of each supplementary tightening fabric portion 22 both have a shape having the same width at the top and the bottom, in FIG. 18B the front and rear parts 22A and 22B of each supplementary tightening fabric portion 22 both have a shape that is pointed at the top, and in FIG. 18C the front and rear parts 22A and 22B of each supplementary tightening fabric portion 22 both have a shape that is broader at the top. In the case of this ninth variation, again the direction in which each of the tightening fabric portions 21 and the supplementary tightening fabric portions 22 stretches approximately coincides with the direction in which the tightening fabric portion 21 or supplementary tightening fabric portion 22 runs, and hence the tightening fabric portions 21 and the supplementary tightening fabric portions 22 act on the piriform muscles and the iliopsoas muscles and thus there is an effect of improving the posture.

Figure 19A:
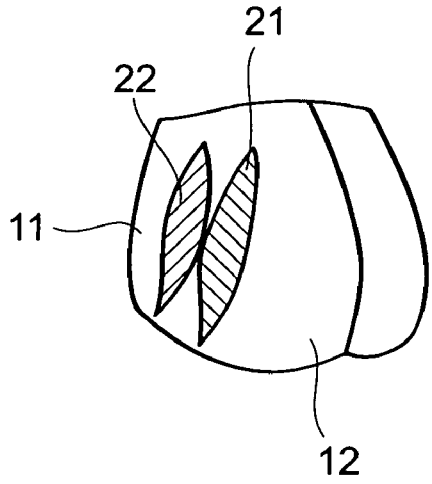
FIG. 19A is a rear perspective view of a short girdle showing a tenth variation of the embodiment.
Figure 19B:
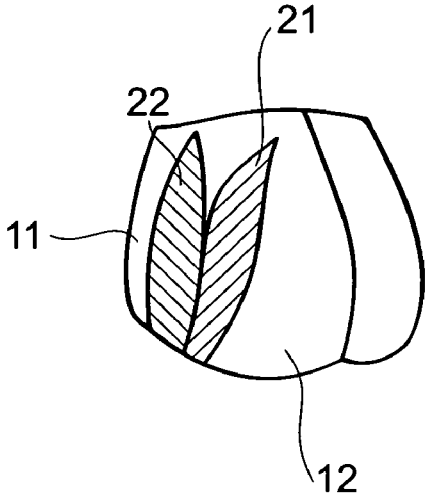
FIG. 19B is a rear perspective view of a short girdle showing the tenth variation of the embodiment.
Figure 19C:
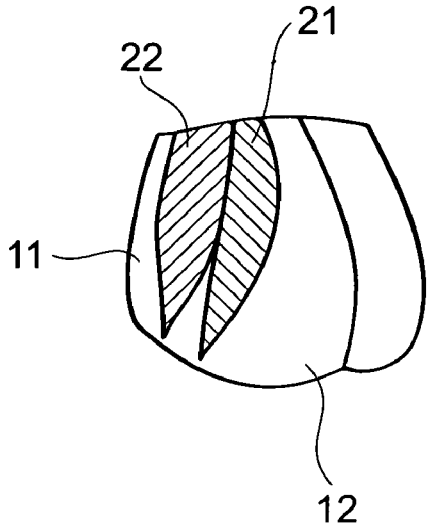
FIG. 19C is a rear perspective view of a short girdle showing the tenth variation of the embodiment.

FIGS. 19A to 19C are perspective views from the rear of short type girdles according to a tenth variation of the embodiment. With the girdle of each of FIGS. 19A to 19C, each of a left/right pair of supplementary tightening fabric portions 22 is positioned in front of a tightening fabric portion 21 in the lumbar region on the left or the right, and each of the tightening fabric portions 21 runs from the vicinity of a greater trochanter to above a buttock. The difference between the girdles of FIGS. 19A to 19C is that in FIG. 19A the tightening fabric portions 21 and the supplementary tightening fabric portions 22 have a pointed shape at both the top and the bottom, in FIG. 19B the tightening fabric portions 21 and the supplementary tightening fabric portions 22 have an overlapping shape at the bottom and a pointed shape at the top, and in FIG. 19C the tightening fabric portions 21 and the supplementary tightening fabric portions 22 have an overlapping shape at the top and a pointed shape at the bottom.

Moreover, in all of the cases a single girdle is constituted by sewing together the left and right fabric portions, there is a front waste fabric portion 11 in front of the supplementary tightening fabric portions 22, and the tightening fabric portions 21 are surrounded by a hip fabric portion 12. The direction in which each of the tightening fabric portions 21 and the supplementary tightening fabric portions 22 stretches (the direction in which there is a weak tightening force) is the direction in which the tightening fabric portion 21 or supplementary tightening fabric portion 22 runs, but the tightening force of the front waste fabric portion 11 and the hip fabric portion 12 has no directional dependence. According to this tenth variation, the tightening fabric portions 21 and the supplementary tightening fabric portions 22 can be constituted from different materials, and hence the magnitudes and directions of the tightening forces acting on the piriform muscles and the iliopsoas muscles can be set separately and suitably, and thus the posture can be improved.

Figure 20A:
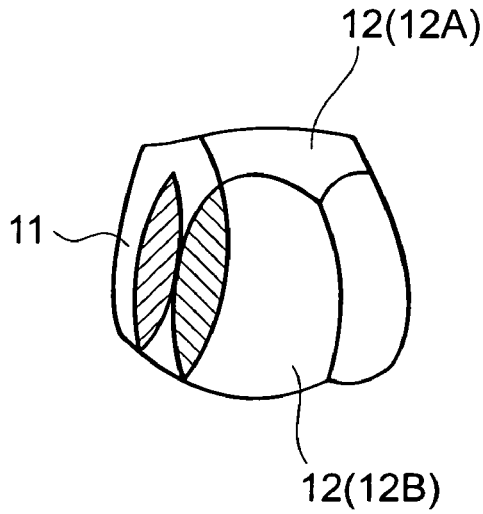
FIG. 20A is a rear perspective view of a short girdle showing an eleventh variation of the embodiment.
Figure 20B:
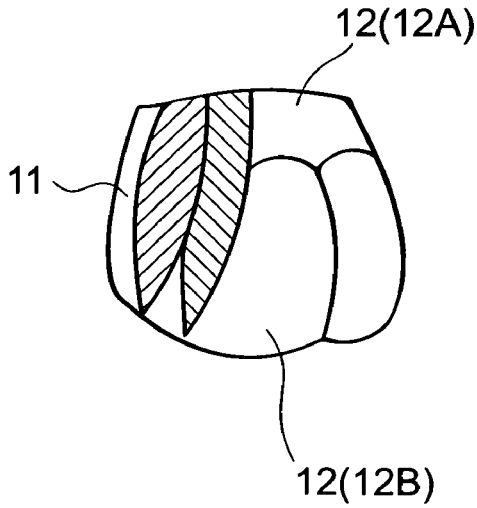
FIG. 20B is a rear perspective view of a short girdle showing the eleventh variation of the embodiment.
Figure 20C:
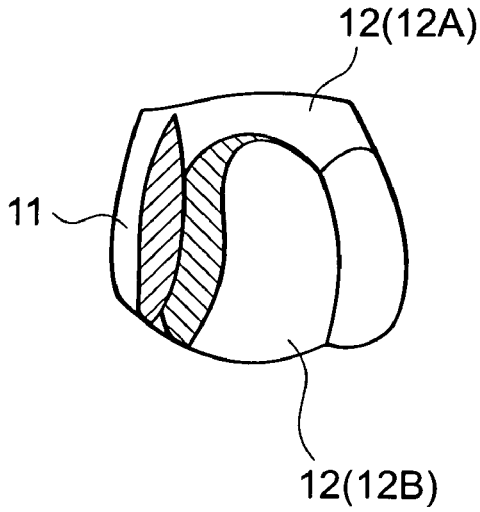
FIG. 20C is a rear perspective view of a short girdle showing the eleventh variation of the embodiment.

FIGS. 20A to 20C are perspective views from the rear of short type girdles according to an eleventh variation of the embodiment. In each of FIGS. 20A to 20C, each supplementary tightening fabric portion 22 is positioned in front of a tightening fabric portion 21, and each of the tightening fabric portions 21 runs from the vicinity of a greater trochanter to above a buttock. The difference between the girdles of FIGS. 20A to 20C is that in FIG. 20A the tightening fabric portions 21 and the supplementary tightening fabric portions 22 have a pointed shape at both the top and the bottom, in FIG. 20B the tightening fabric portions 21 and the supplementary tightening fabric portions 22 have an overlapping shape at the top and a pointed shape at the bottom, and in FIG. 20C the tightening fabric portions 21 and the supplementary tightening fabric portions 22 have an overlapping shape at the bottom and a pointed shape at the top.

Moreover, in all of the cases there is a front waste fabric portion 11 in front of the supplementary tightening fabric portions 22, and the hip fabric portion 12 is constituted from an upper part 12A and lower parts 12B. The direction in which there is a strong tightening force in each of the tightening fabric portions 21 and the supplementary tightening fabric portions 22 is the direction orthogonal to the direction in which the tightening fabric portion 21 or supplementary tightening fabric portion 22 runs, but the tightening force of the front waste fabric portion 11 and the hip fabric portion 12 has no directional dependence. According to this eleventh variation, again the tightening fabric portions 21 and the supplementary tightening fabric portions 22 can be constituted from different materials, and hence the magnitudes and directions of the tightening forces acting on the piriform muscles and the iliopsoas muscles can be set separately and suitably, and thus the posture can be improved.

Figure 21A:
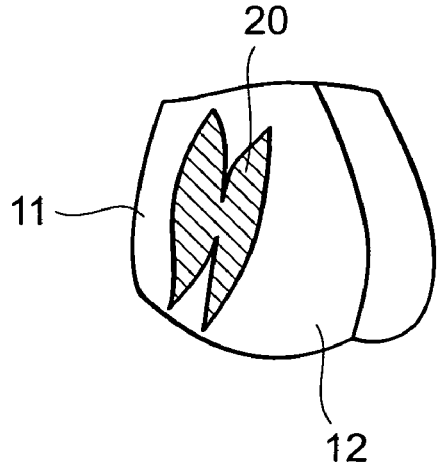
FIG. 21A is a rear perspective view of a short girdle showing a twelfth variation of the embodiment.
Figure 21B:
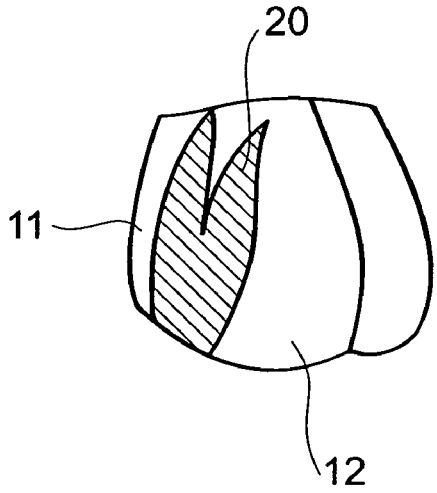
FIG. 21B is a rear perspective view of a short girdle showing the twelfth variation of the embodiment.
Figure 21C:
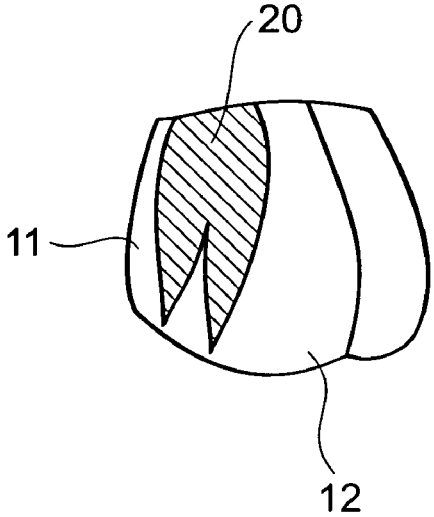
FIG. 21C is a rear perspective view of a short girdle showing the twelfth variation of the embodiment.

FIGS. 21A to 21C are perspective views from the rear of short type girdles according to a twelfth variation of the embodiment. With the girdle of each of FIGS. 21A to 21C, a left/right pair of tightening fabric portions 20 are provided, with each tightening fabric portion 20 being a single body but being divided into front and rear parts. The front of each tightening fabric portion 20 fits over the lumbar region on the left or the right, and the rear of each tightening fabric portion 20 runs from the vicinity of a greater trochanter to above a buttock. The difference between the girdles of FIGS. 21A to 21C is that in FIG. 21A the tightening fabric portions 20 have a pointed shape at both the top and the bottom, in FIG. 21B the tightening fabric portions 20 have a pointed shape at the top, and in FIG. 21C the tightening fabric portions 20 have a pointed shape at the bottom.

Moreover, in all of the cases a single girdle is constituted by sewing together the left and right fabric portions, there is a front waste fabric portion 11 in front of the tightening fabric portions 20, and a hip fabric portion 12 is sewn on behind the tightening fabric portions 20. The direction in which there is a strong tightening force in each of the tightening fabric portions 20 is the direction orthogonal to the direction in which the tightening fabric portion 20 runs, but the tightening force of the front waste fabric portion 11 and the hip fabric portion 12 has no directional dependence. According to this twelfth variation, the tightening fabric portions 20 act on the piriform muscles and the iliopsoas muscles, and hence the posture can be improved.

Figure 22A:
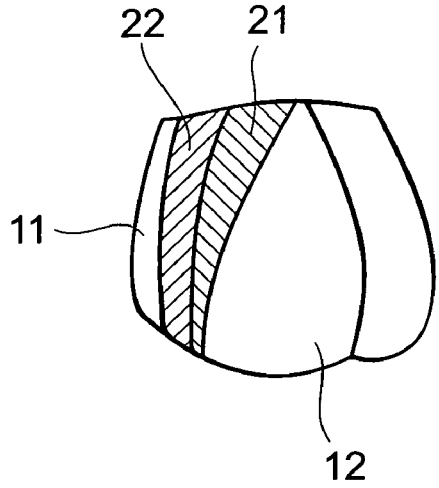
FIG. 22A is a rear perspective view of a short girdle showing a thirteenth variation of the embodiment.
Figure 22B:
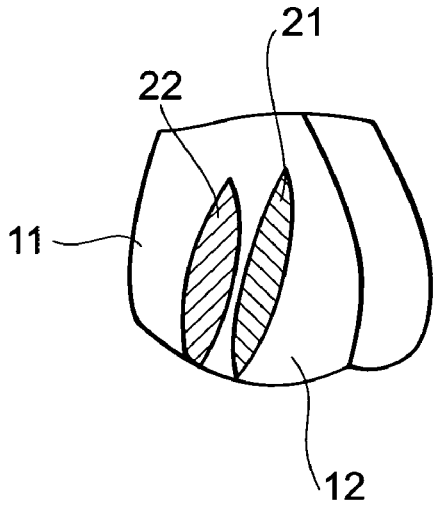
FIG. 22B is a rear perspective view of a short girdle showing the thirteenth variation of the embodiment.
Figure 22C:
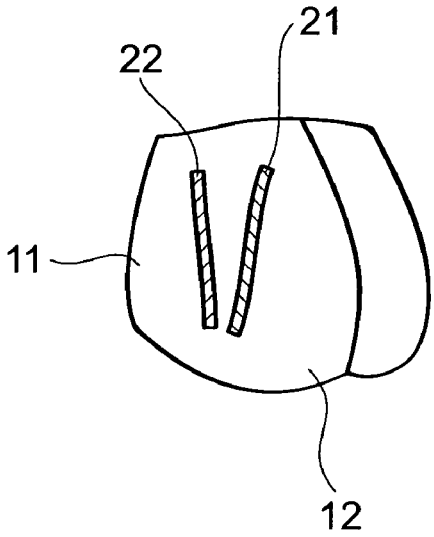
FIG. 22C is a rear perspective view of a short girdle showing the thirteenth variation of the embodiment.

FIGS. 22A to 22C are perspective views from the rear of short type girdles according to a thirteenth variation of the embodiment. In each of FIGS. 22A to 22C, each supplementary tightening fabric portion 22 is positioned in front of a tightening fabric portion 21, and each of the tightening fabric portions 21 runs from the vicinity of a greater trochanter to above a buttock. The difference between the girdles of FIGS. 22A to 22C is that in FIG. 22A the tightening force for both the tightening fabric portions 21 and the supplementary tightening fabric portions 22 can be adjusted by tightening a cord, in FIG. 22B the tightening fabric portions 21 and the supplementary tightening fabric portions 22 are constituted using coil bone, and in FIG. 22C the tightening fabric portions 21 and the supplementary tightening fabric portions 22 are constituted using an elastomer resin.

Moreover, in all of the cases there is a front waste fabric portion 11 in front of the supplementary tightening fabric portions 22, and there is a hip fabric portion 12 behind the tightening fabric portions 21. The direction in which there is a strong tightening force in each of the tightening fabric portions 21 and the supplementary tightening fabric portions 22 is the direction orthogonal to the direction in which the tightening fabric portion 21 or supplementary tightening fabric portion 22 runs, but the tightening force of the front waste fabric portion 11 and the hip fabric portion 12 has no directional dependence. According to this thirteenth variation, again the tightening fabric portions 21 and the supplementary tightening fabric portions 22 can be constituted using different materials and knitting methods, and hence the magnitudes and directions of the tightening forces acting on the piriform muscles and the iliopsoas muscles can be set separately and suitably, and thus the posture can be improved.

Figure 23A:
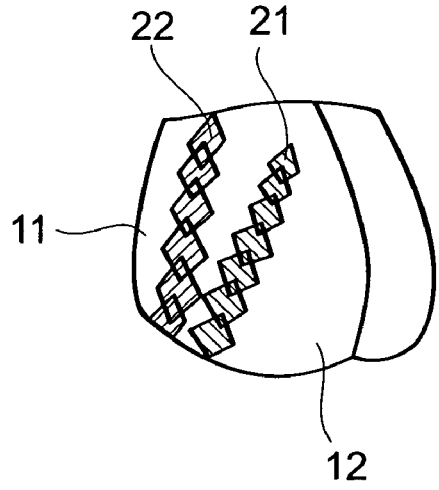
FIG. 23A is a rear perspective view of a short girdle showing a fourteenth variation of the embodiment.
Figure 23B:
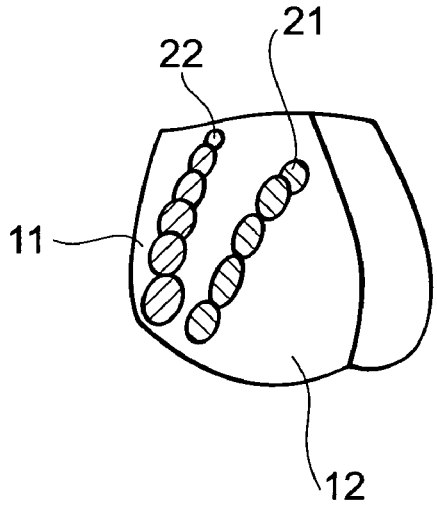
FIG. 23B is a rear perspective view of a short girdle showing the fourteenth variation of the embodiment.
Figure 23C:
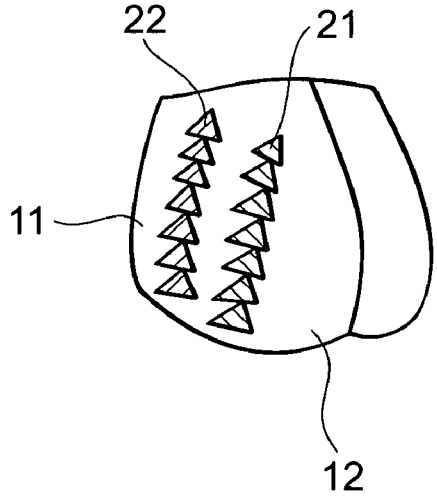
FIG. 23C is a rear perspective view of a short girdle showing the fourteenth variation of the embodiment.

FIGS. 23A to 23C are perspective views from the rear of short type girdles according to a fourteenth variation of the embodiment. In each of FIGS. 23A to 23C, each supplementary tightening fabric portion 22 is positioned in front of a tightening fabric portion 21, and each of the tightening fabric portions 21 runs from the vicinity of a greater trochanter to above a buttock. The difference between the girdles of FIGS. 23A to 23C is that in FIG. 23A the tightening fabric portions 21 and the supplementary tightening fabric portions 22 are constituted by arranging a plurality of diamond-shape patches in a line, in FIG. 23B the tightening fabric portions 21 and the supplementary tightening fabric portions 22 are constituted by arranging a plurality of circular patches in a line, and in FIG. 23C the tightening fabric portions 21 and the supplementary tightening fabric portions 22 are constituted by arranging a plurality of triangular patches in a line.

Moreover, in all of the cases there is a front waste fabric portion 11 in front of the supplementary tightening fabric portions 22, and there is a hip fabric portion 12 behind the tightening fabric portions 21. The direction in which there is a strong tightening force in each of the tightening fabric portions 21 and the supplementary tightening fabric portions 22 is the direction orthogonal to the direction in which the tightening fabric portion 21 or supplementary tightening fabric portion 22 runs, but the tightening force of the front waste fabric portion 11 and the hip fabric portion 12 has no directional dependence. According to this fourteenth variation, again the tightening fabric portions 21 and the supplementary tightening fabric portions 22 can be constituted using different materials and sewing methods, and hence the magnitudes and directions of the tightening forces acting on the piriform muscles and the iliopsoas muscles can be set separately and suitably.

Figure 24A:
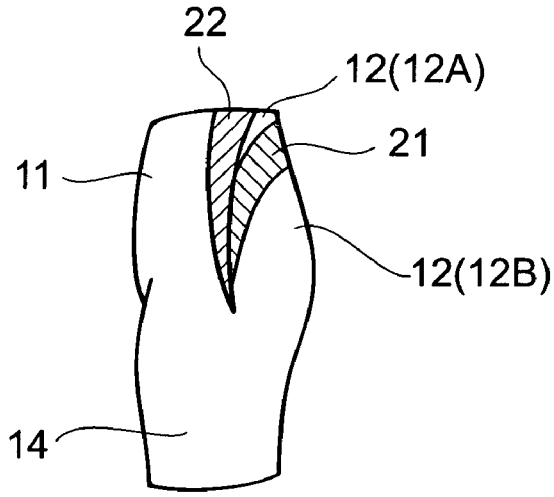
FIG. 24A is a side view of a long girdle showing a fifteenth variation of the embodiment.
Figure 24B:
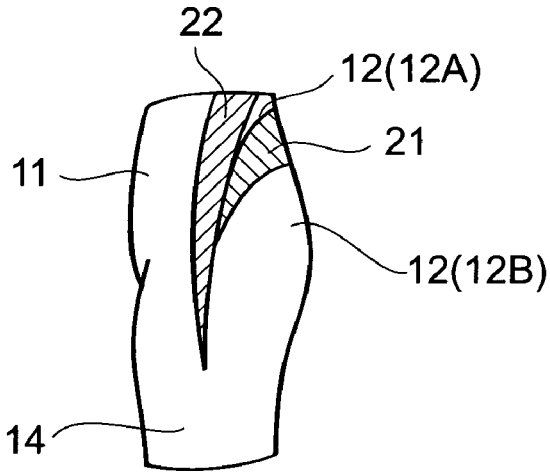
FIG. 24B is a side view of a long girdle showing the fifteenth variation of the embodiment.
Figure 24C:
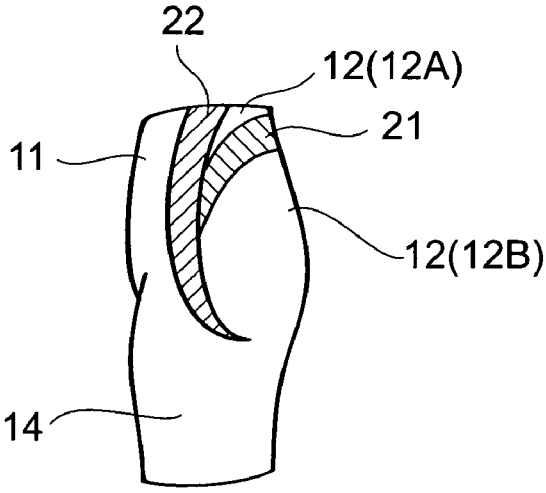
FIG. 24C is a side view of a long girdle showing the fifteenth variation of the embodiment.

FIGS. 24A to 24C are side views of long type girdles according to a fifteenth variation of the embodiment. In each of FIGS. 24A to 24C, there are a front waste fabric portion 11 that fits over the front of the lower abdomen of the wearer, a hip fabric portion 12 that fits over the buttocks, a crotch fabric portion (not shown) that fits over the crotch, and thigh fabric portions 14 that fit over the thighs. A single girdle is constituted by sewing tightening fabric portions 21 and supplementary tightening fabric portions 22 that fit over the wearer's body to the fabric portions 11, 12, 14 and so on.

In this way, the tightening fabric portions 21 and the supplementary tightening fabric portions 22, which apply tightening forces to the lumbar region of the wearer, are provided in areas suitably fitting over the lumbar region (the left and right of the lumbar region) so as to form constituent elements of the garment (long girdle) itself, and hence handling is easy, and there is no detriment to the feeling when worn.

With the long girdles of FIG. 24, each of the supplementary tightening fabric portions 22 has a shape that is pointed at the bottom, and is positioned in front of a tightening fabric portion 21. Each of the tightening fabric portions 21 runs from above a buttock to the vicinity of a greater trochanter, and moreover runs downward between thigh fabric portions 14 to the center of a thigh. The difference between the girdles of FIGS. 24A to 24C is that in FIG. 24A the tightening fabric portions 21 and the supplementary tightening fabric portions 22 both run downward to approximately the same position, in FIG. 24B the supplementary tightening fabric portions 22 run further down than the tightening fabric portions 21, and in FIG. 24C the supplementary tightening fabric portions 22 run further down and moreover are curved backward when the girdle is being worn.

Moreover, in each of the cases, the hip fabric portion 12 is constituted from an upper part 12A above the tightening fabric portions 21 and a lower part 12B below the tightening fabric portions 21. The direction in which there is a strong tightening force in each of the tightening fabric portions 21 and the supplementary tightening fabric portions 22 is the direction orthogonal to the direction in which the tightening fabric portion 21 or supplementary tightening fabric portion 22 runs, but the tightening force of the front waste fabric portion 11, the hip fabric portion 12 and the thigh fabric portions 14 has no directional dependence. According to this fifteenth variation, again the tightening fabric portions 21 and the supplementary tightening fabric portions 22 can be constituted from different materials, and hence the magnitudes and directions of the tightening forces acting on the piriform muscles and the iliopsoas muscles can be set separately and suitably, and thus the posture can be improved. In particular, in the case of FIG. 24C, because the supplementary tightening fabric portions 22 run right down and moreover are curved backward, there is an effect of the rotation required to change the posture being easily brought about.

Figure 25A:
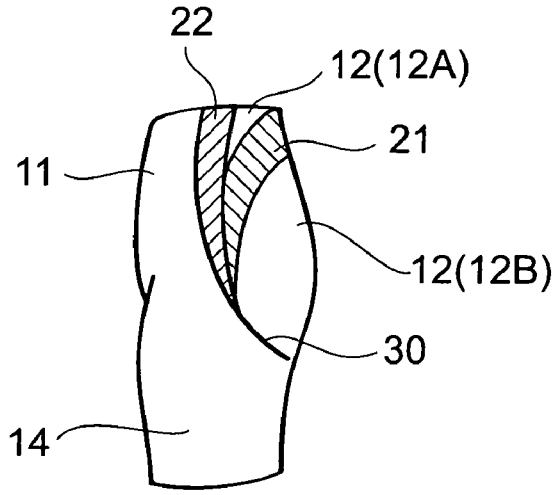
FIG. 25A is a side view of a long girdle showing a sixteenth variation of the embodiment.
Figure 25B:
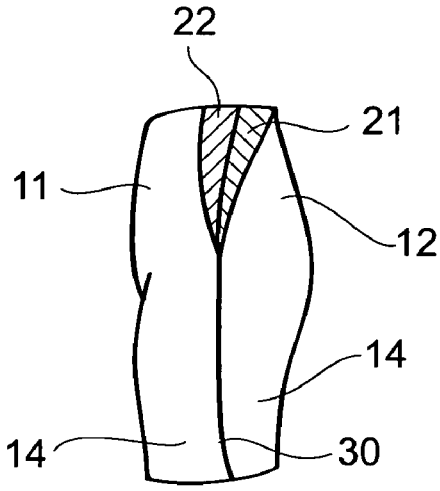
FIG. 25B is a side view of a long girdle showing the sixteenth variation of the embodiment.
Figure 25C:
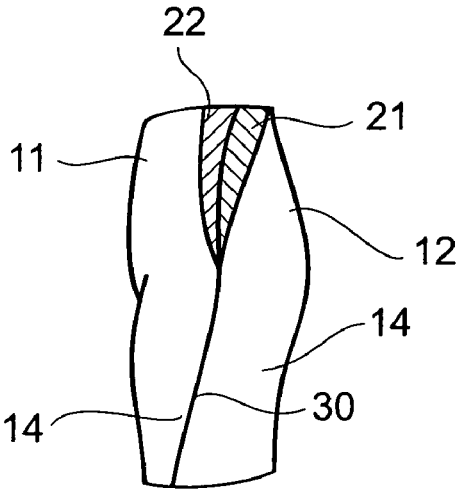
FIG. 25C is a side view of a long girdle showing the sixteenth variation of the embodiment.
Figure 26A:
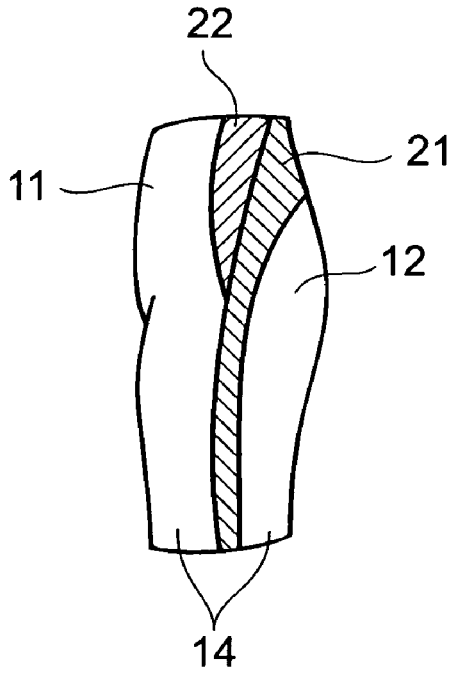
FIG. 26A is a side view of a long girdle showing a seventeenth variation of the embodiment.
Figure 26C:
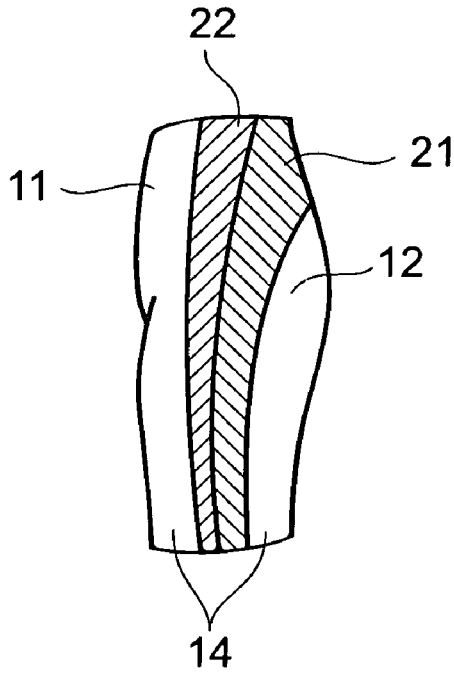
FIG. 26C is a side view of a long girdle showing the seventeenth variation of the embodiment.
Figure 26B:
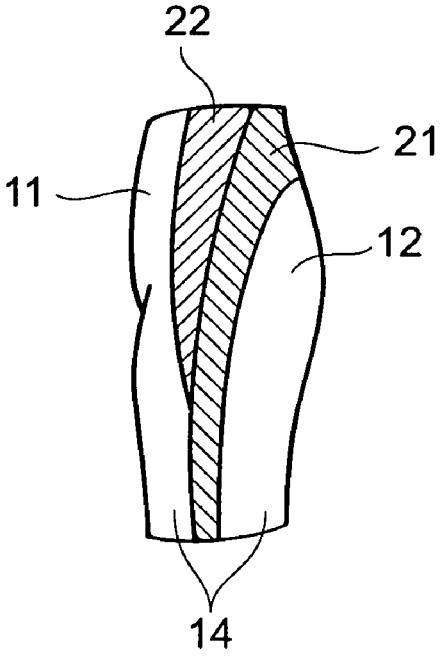
FIG. 26B is a side view of a long girdle showing the seventeenth variation of the embodiment.
Figure 26D:
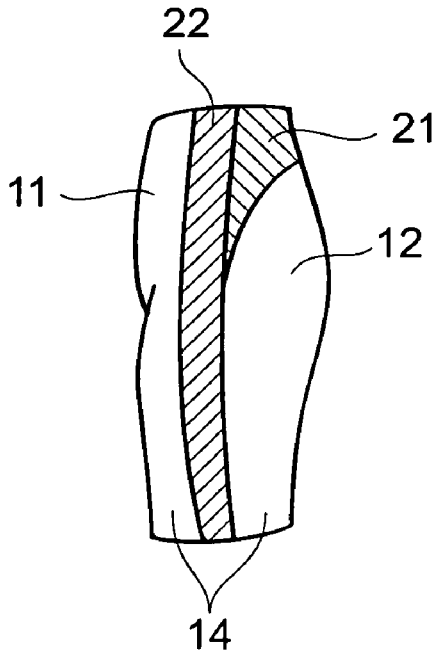
FIG. 26D is a side view of a long girdle showing the seventeenth variation of the embodiment.

FIGS. 25A to 25C are side views of long type girdles according to a sixteenth variation of the embodiment. In each of FIGS. 25A to 25C, there are a front waste fabric portion 11, a hip fabric portion 12, and a crotch fabric portion, and also thigh fabric portions 14 that fit over the thighs; a single girdle is constituted by sewing tightening fabric portions 21 and supplementary tightening fabric portions 22 to the fabric portions 11, 12, 14 and so on.

The tightening fabric portions 21 and the supplementary tightening fabric portions 22 both have a shape that is pointed at the bottom, and run to approximately the same position in the vicinity of a greater trochanter. Moreover, a cut line 30 further runs from the tip of each tightening fabric portion 21 and supplementary tightening fabric portion 22 across the thigh fabric portion 14 downward. The difference between FIGS. 25A to 25C is that in FIG. 25A each cut line 30 runs backward in curved fashion to below a buttock, in FIG. 25B each cut line 30 runs diagonally backward to a lower edge above a knee, and in FIG. 25C each cut line 30 runs diagonally forward to a lower edge above a knee.

Moreover, in the case of FIG. 25A, the hip fabric portion 12 is constituted from an upper part 12A above the tightening fabric portions 21 and a lower part 12B below the tightening fabric portions 21. The direction in which there is a strong tightening force in each of the tightening fabric portions 21 and the supplementary tightening fabric portions 22 is the direction orthogonal to the direction in which the tightening fabric portion 21 or supplementary tightening fabric portion 22 runs, but the tightening force of the front waste fabric portion 11, the hip fabric portion 12 and the thigh fabric portions 14 has no directional dependence. According to this sixteenth variation, again the tightening fabric portions 21 and the supplementary tightening fabric portions 22 can be constituted from different materials, and furthermore the thigh fabric portions 14 can also be constituted from different materials, and hence the magnitudes and directions of the tightening forces acting on the piriform muscles and the iliopsoas muscles can be set separately and suitably, and thus the posture can be improved. In particular, in the case of FIG. 25A, because the cut lines 30 run right down and moreover are curved backward, there is an effect of the rotation required to change the posture being easily brought about.

FIGS. 26A to 26D are side views of long type girdles according to a seventeenth variation of the embodiment. In each of FIGS. 26A to 26D, there are a front waste fabric portion 11, a hip fabric portion 12, and a crotch fabric portion, and also thigh fabric portions 14 that fit over the thighs; a single girdle is constituted by sewing tightening fabric portions 21 and supplementary tightening fabric portions 22 to the fabric portions 11, 12, 14 and so on.

The tightening fabric portions 21 and the supplementary tightening fabric portions 22 are adjacent to one another, and run downward. The difference between the girdles of FIGS. 26A to 26D is that in FIG. 26A each tightening fabric portion 21 runs as far as a lower edge above a knee and each supplementary tightening fabric portion 22 runs in a pointed shape as far as the vicinity of a greater trochanter, in FIG. 26B each tightening fabric portion 21 runs as far as a lower edge above a knee and each supplementary tightening fabric portion 22 runs in a pointed shape as far as a thigh part below a greater trochanter, in FIG. 26C each tightening fabric portion 21 and supplementary tightening fabric portion 22 both run as far as a lower edge above a knee, and in FIG. 26D each supplementary tightening fabric portion 22 runs as far as a lower edge above a knee and each tightening fabric portion 21 runs in a pointed shape as far as the vicinity of a greater trochanter.

Moreover, the direction in which there is a strong tightening force in each of the tightening fabric portions 21 and the supplementary tightening fabric portions 22 is the direction orthogonal to the direction in which the tightening fabric portion 21 or supplementary tightening fabric portion 22 runs, but the tightening force of the front waste fabric portion 11, the hip fabric portion 12 and the thigh fabric portions 14 has no directional dependence. According to this seventeenth variation, again the tightening fabric portions 21 and the supplementary tightening fabric portions 22 can be constituted from different materials, and furthermore the thigh fabric portions 14 can also be constituted from different materials, and hence the magnitudes and directions of the tightening forces acting on the piriform muscles and the iliopsoas muscles can be set separately and suitably, and thus the posture can be improved.

Moreover, in the embodiments, description has been given for the case that the crotch-possessing corrective garment is a short girdle or a long girdle, but the crotch-possessing corrective garment may be any of various other ones such as spats, sports tights, a leotard, a body suit, or men's pants, tights or spats.

INDUSTRIAL APPLICABILITY

The present invention can be applied to a crotch-possessing corrective garment such as a girdle for posture correction.

The invention claimed is:

1. A crotch-possessing corrective garment comprising:

a tightening portion in an area fitting over a wearer's body, for which the magnitude of the tightening portion's resistance to stretching varies with direction;

wherein when the garment is being worn, the tightening portion runs from above the anal cleft of the wearer's body, extending both left and right passing above the left and right buttocks of the wearer's body, and downwards to a position overlying the left and right greater trochanters at left and right outer sides of the wearer's body, and the tightening portion's resistance to stretching in the direction in which the tightening portion runs is made to be lower than the tightening portion's resistance to stretching in the direction orthogonal thereto in a plane parallel to the surface of the skin of the wearer's body over which the tightening portion overlies, and wherein a left and right pair of supplementary tightening portions are provided so as to run along the tightening portion in front of the tightening portion in the lumbar region on the left and the right of the wearer's body, and the supplementary tightening portions' resistance to stretching in the direction in which each of the left and right pair of supplementary tightening portions runs is made to be lower than the supplementary tightening portions' resistance to stretching in the direction orthogonal thereto in a plane parallel to the surface of the skin of the wearer's body over which each of the supplementary tightening portions overlie.

2. The crotch-possessing corrective garment according to claim 1, further having thigh portions that fit over the wearer's thighs, wherein the tightening portion further runs from the position overlying the greater trochanters along the outsides of the thigh portions.

3. The crotch-possessing corrective garment according to claim 1, wherein when the garment is being worn, the tightening portion has a shape that is curved above the buttocks of the wearer's body in the plane parallel to the surface of the skin of the wearer's body over which the tightening portion overlies.

4. The crotch-possessing corrective garment according to claim 1, wherein when the garment is being worn, in a left lumbar region and a right lumber region of the wearer's body, the tightening portion is forked upward to form front and rear forks, and the rear forks run from the position overlying the left and right greater trochanters of the wearer's body to above the left and right buttocks of the wearer's body such as to point to above the anal cleft of the wearer's body, and the front forks run from the greater trochanters of the wearer's body upward.

5. The crotch-possessing corrective garment comprising:

a tightening portion in an area fitting over a wearer's body;

and supplementary tightening portions for which the magnitude of the tightening portion's and the supplementary tightening portions' resistance to stretching varies with direction;

wherein the tightening portion runs from a position overlying the left and right greater trochanters at left and right outer sides of the wearer's body upwards to above the left and right buttocks of the wearer's body such as to point to above the anal cleft of the wearer's body when the garment is being worn, and the supplementary tightening portions are provided along the tightening portions in front of the tightening portion;

and the resistance to stretching in the direction in which each of the tightening portion and the supplementary tightening portions runs is made to be lower than the resistance to stretching in the direction orthogonal thereto in a plane parallel to the surface of the skin of the wearer's body over which the tightening portion and each of the supplementary tightening portions overlie.

6. The crotch-possessing corrective garment according to claim 1, wherein the supplementary tightening portions are made so as to broaden as the supplementary tightening portions run downward along the tightening portion when the garment is being worn.

7. The crotch-possessing corrective garment according to claim 5, wherein the supplementary tightening portions are made so as to narrow as the supplementary tightening portions run upwards along the tightening portion when the garment is being worn.

8. The crotch-possessing corrective garment according to claim 1, further comprising a body front tightening portion that is constituted from a material having a resistance to stretching, and runs from above the crotch in the front center of the wearer's body, upward to the left and right when the garment is being worn.

9. The crotch-possessing corrective garment according to claim 5, further comprising a body front tightening portion that is constituted from a material having a resistance to stretching, and runs from above the crotch in the front center of the wearer's body, upward to the left and right when the garment is being worn.

10. The crotch-possessing corrective garment according to claim 1, wherein the tightening portion has an approximately constant width.

11. The crotch-possessing corrective garment according to claim 5, wherein the tightening portion has an approximately constant width.

12. The crotch-possessing corrective garment according to claim 1, wherein the tightening portion is formed in a single piece of fabric by at least one of circular knitting and warp-knitting.

13. The crotch-possessing corrective garment according to claim 5, wherein the tightening portion is formed in a single piece of fabric by at least one of circular knitting and warp-knitting.

14. A crotch-possessing corrective garment comprising:

a left and right pair of tightening portions in an area fitting over a wearer's body, for which the magnitude of the tightening portions' resistance to stretching varies with direction;

wherein when the garment is being worn, each of the left and right pair of tightening portions runs from a position overlying one of the left and right greater trochanter at left and right outer sides of the wearer's body upwards to above one of the left and right buttock of the wearer's body such as to point to above the anal cleft of the wearer's body, and the tightening portions' resistance to stretching in the direction in which each of the left and right pair of tightening portions run is made to be lower than the tightening portions' resistance to stretching in the direction orthogonal thereto in a plane parallel to the surface of the skin of the wearer's body over which each of the tightening portions overlie, and wherein a left and right pair of supplementary tightening portions are provided so as to run along the tightening portions in front of the tightening portions in the lumbar region on the left and the right of the wearer's body, and the supplementary tightening portions' resistance to stretching in the direction in which each of the left and right pair of supplementary tightening portions runs is made to be lower than the tightening force in the direction orthogonal thereto in a plane parallel to the surface of the skin of the wearer's body over which each of the supplementary tightening portions overlie.

15. The crotch-possessing corrective garment according to claim 14, further having thigh portions that fit over the wearer's thighs, wherein the tightening portions further run from the position overlying the greater trochanters along the outsides of the thigh portions.

16. The crotch-possessing corrective garment according to claim 14, wherein when the garment is being worn, the tightening portions have a shape that is curved above the buttocks of the wearer's body in the plane parallel to the surface of the skin of the wearer's body over which the tightening portions overlie.

17. The crotch-possessing corrective garment according to claim 14, wherein when the garment is being worn, in a left lumbar region and a right lumber region of the wearer's body, the tightening portions are forked upward to form front and rear forks, and the rear forks run from the position overlying the left and right greater trochanters of the wearer's body to above the left and right buttocks of the wearer's body such as to point to above the anal cleft of the wearer's body, and the front forks run from the greater trochanters of the wearer's body upward.

18. The crotch-possessing corrective garment according to claim 14, wherein the supplementary tightening portions are made so as to narrow as the supplementary tightening portions run upwards along the tightening portion when the garment is being worn.

19. The crotch-possessing corrective garment according to claim 14, further comprising a body front tightening portion that is constituted from a material having a resistance to stretching, and runs from above the crotch in the front center of the wearer's body, upward to the left and right when the garment is being worn.

20. The crotch-possessing corrective garment according to claim 14, wherein the tightening portions have an approximately constant width.

21. The crotch-possessing corrective garment according to claim 14, wherein the tightening portions are formed in a single piece of fabric by at least one of circular knitting and warp-knitting.

* * * * *